US012704304B2

(12) United States Patent
Feng et al.

(10) Patent No.: US 12,704,304 B2
(45) Date of Patent: Aug. 11, 2026

(54) SYSTEMS AND METHODS FOR REFRIGERANT LEAKAGE DIAGNOSIS

(71) Applicant: Tyco Fire & Security GmbH, Neuhausen am Rheinfall (CH)

(72) Inventors: Zhanhui Feng, Milwaukee, WI (US); Xiaokui Ma, Milwaukee, WI (US); Li Wang, Milwaukee, WI (US); Baojun Chang, Milwaukee, WI (US)

(73) Assignee: TYCO FIRE & SECURITY GMBH, Neuhausen am Rheinfall (CH)

( * ) Notice: Subject to any disclaimer, the term of this patent is extended or adjusted under 35 U.S.C. 154(b) by 276 days.

(21) Appl. No.: 18/240,291

(22) Filed: Aug. 30, 2023

(65) Prior Publication Data

US 2024/0068721 A1 Feb. 29, 2024

(30) Foreign Application Priority Data

Aug. 31, 2022 (CN) ..... 202211053935.7

(51) Int. Cl.
*F24F 11/36* (2018.01)
*F25B 49/00* (2006.01)

(52) U.S. Cl.
CPC ..... *F25B 49/005* (2013.01); *F24F 11/36* (2018.01); *F25B 2500/222* (2013.01)

(58) Field of Classification Search
CPC .... F24F 11/36; F25B 49/005; F25B 2500/222
See application file for complete search history.

(56) References Cited

U.S. PATENT DOCUMENTS

| | | | |
|---|---|---|---|
| 10,928,084 | B2 | 2/2021 | Ajax et al. |
| 2019/0170603 | A1 | 6/2019 | Gupte et al. |
| 2020/0300495 | A1* | 9/2020 | Kingetsu ..... F24F 11/58 |
| 2021/0071889 | A1 | 3/2021 | Picardi et al. |
| 2021/0191826 | A1 | 6/2021 | Duraisingh et al. |

(Continued)

OTHER PUBLICATIONS

Feng et al., "A Semi-Supervised Data-Driven Approach for Chiller Refrigerant Leakage Detection," 3rd IIR Conference on HFO Refrigerants and Low GWP Blends, Shanghai, China, 2023 (8 pages).

(Continued)

*Primary Examiner* — Jonathan Bradford
(74) *Attorney, Agent, or Firm* — Foley & Lardner LLP

(57) ABSTRACT

A system for refrigerant leakage detection includes one or more sensors configured to detect one or more parameters of a building system including a refrigerant. The system further includes one or more storage devices storing instructions thereon that, when executed by one or more processors, cause the one or more processors to receive sensor data from the one or more sensors; apply the sensor data to a long short-term memory (LSTM) model to generate predicted sensor data corresponding to the one or more sensors; receive subsequent sensor data from the one or more sensors; compare the predicted sensor data to the subsequent sensor data; determine that the building system has a refrigerant leakage based on the comparison of the predicted sensor data to the subsequent sensor data; and, responsive to determining that the building system has the refrigerant leakage, take an action to address the refrigerant leakage.

15 Claims, 17 Drawing Sheets

(56) References Cited

U.S. PATENT DOCUMENTS

| | | | | |
|---|---|---|---|---|
| 2021/0278102 | A1 | 9/2021 | Sabat et al. | |
| 2022/0268479 | A1* | 8/2022 | Jang | G06N 3/09 |
| 2022/0268503 | A1* | 8/2022 | Yoshimi | F24F 11/64 |
| 2022/0390913 | A1 | 12/2022 | Pelski et al. | |
| 2023/0116964 | A1 | 4/2023 | Sun et al. | |
| 2023/0169220 | A1 | 6/2023 | Ramanasankaran et al. | |
| 2023/0194137 | A1 | 6/2023 | Fan et al. | |
| 2024/0035695 | A1 | 2/2024 | Mohammad et al. | |
| 2024/0068721 | A1 | 2/2024 | Feng et al. | |

OTHER PUBLICATIONS

Trinh et al., "Detecting Mobile Traffic Anomalies Through Physical Control Channel Fingerprinting: A Deep Semi-Supervised Approach," IEEE Access, Oct. 2019, vol. 7 (pp. 152187-152201).
U.S. Appl. No. 18/895,144, filed Sep. 24, 2024, O'Dierno et al.

* cited by examiner

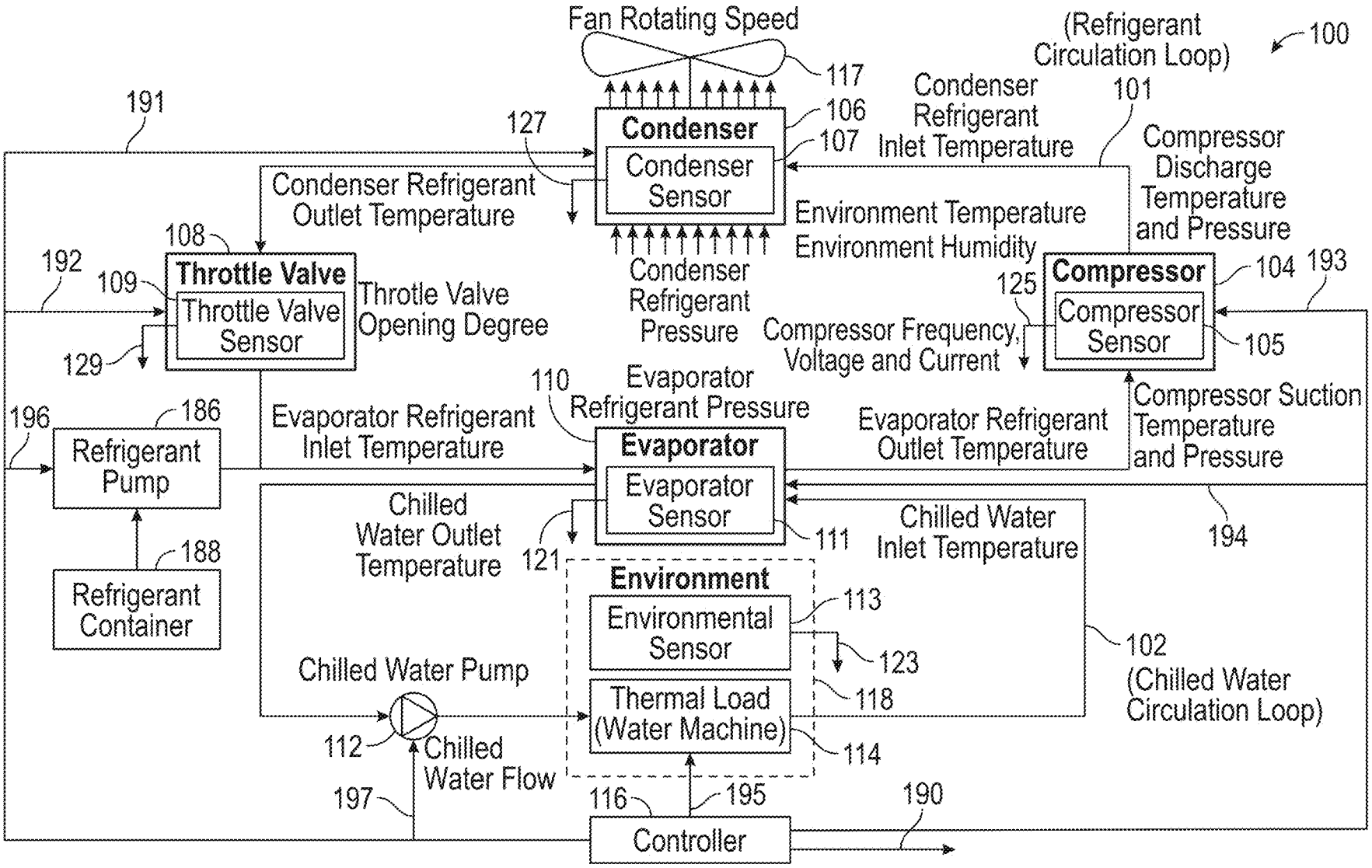
100
(Refrigerant Circulation Loop)
101
Compressor Discharge Temperature and Pressure
104
105
193
Compressor
Compressor Sensor
Compressor Suction Temperature and Pressure
194
102
(Chilled Water Circulation Loop)
Condenser Refrigerant Inlet Temperature
Environment Temperature
Environment Humidity
125
Compressor Frequency, Voltage and Current
Evaporator Refrigerant Outlet Temperature
Chilled Water Inlet Temperature
117
106
107
Fan Rotating Speed
Condenser
Condenser Sensor
Condenser Refrigerant Pressure
Evaporator Refrigerant Pressure
Evaporator
Evaporator Sensor
111
113
123
118
114
190
Environment
Environmental Sensor
Thermal Load (Water Machine)
195
116
Controller
FIG. 1A
127
110
121
Condenser Refrigerant Outlet Temperature
Throttle Valve Opening Degree
Evaporator Refrigerant Inlet Temperature
Chilled Water Outlet Temperature
Chilled Water Pump
Chilled Water Flow
112
197
Throttle Valve
Throttle Valve Sensor
108
109
129
186
Refrigerant Pump
188
Refrigerant Container
191
192
196

SYSTEMS AND METHODS FOR REFRIGERANT LEAKAGE DIAGNOSIS

CROSS-REFERENCE TO RELATED PATENT APPLICATION

This application claims the benefit of and priority to Chinese Patent Application No. 202211053935.7, filed Aug. 31, 2022, which is incorporated herein by reference in its entirety.

TECHNICAL FIELD

The present application relates to a diagnostic method for a heat transfer system (e.g., heating, cooling, and/or air conditioning (HVAC) system, a chiller or chiller unit, an air-conditioning unit) that circulates a refrigerant and, in particular, to a diagnostic method for refrigerant leakage in the heat transfer system.

BACKGROUND

A typical heat transfer system that circulates refrigerant (e.g., an HVAC system, a chiller or chiller unit, an air-conditioning unit) generally comprises four main components: a compressor, a condenser, a throttle valve (or another expansion mechanism), and an evaporator. A refrigerant forms a circulation loop in these four components to complete heat transfer. For example, the refrigerant loop is generally sequentially connected to the compressor, the condenser, the throttle valve and the evaporator. A discharge port of the compressor is in fluid communication with an inlet of the condenser, an outlet of the condenser is in fluid communication with an inlet of the throttle valve, an outlet of the throttle valve is in fluid communication with an inlet of the evaporator, and an outlet of the evaporator is in fluid communication with a suction port of the compressor.

The refrigerant is compressed to be in a high-pressure and high-temperature state in the compressor and then discharged into the condenser. Then, the refrigerant exchanges heat with ambient air in the condenser to release heat so as to be condensed to be in a high-pressure and liquid state before being discharged into the throttle valve. In the throttle valve, the refrigerant is expanded and throttled to be in a low-pressure two-phase state. The refrigerant then flows into the evaporator, where it exchanges heat with chilled water to absorb heat so as to be evaporated to be in a low-pressure and gaseous state. The refrigerant then returns to the compressor via the suction port of the compressor to complete refrigerant circulation.

In order to assure proper operating performance and maintenance of the heat transfer system, it is important to detect or otherwise diagnose leakage of the refrigerant within the heat transfer system.

SUMMARY

One implementation of the present disclosure is a system for refrigerant leakage detection. The system comprises one or more sensors configured to detect one or more parameters of a building system including a refrigerant. The system further comprises one or more storage devices storing instructions thereon that, when executed by one or more processors, cause the one or more processors to receive sensor data from the one or more sensors. The instructions further cause the one or more processors to apply the sensor data to a long short-term memory (LSTM) model to generate predicted sensor data corresponding to the one or more sensors. The instructions further cause the one or more processors to receive subsequent sensor data from the one or more sensors. The instructions further cause the one or more processors to compare the predicted sensor data to the subsequent sensor data. The instructions further cause the one or more processors to determine that the building system has a refrigerant leakage based on the comparison of the predicted sensor data to the subsequent sensor data. The instructions further cause the one or more processors to, responsive to determining that the building system has the refrigerant leakage, take an action to address the refrigerant leakage.

Another implementation of the present disclosure is a system for refrigerant leakage detection. The system comprises one or more sensors configured to detect one or more parameters of a building system including a refrigerant. The system further comprises one or more storage devices storing instructions thereon that, when executed by one or more processors, cause the one or more processors to determine reconstruction error enhancement coefficients for each of the one or more sensors. The instructions further cause the one or more processors to receive sensor data from the one or more sensors. The instructions further cause the one or more processors to apply the sensor data to a long short-term memory (LSTM) model to generate predicted sensor data corresponding to the one or more sensors. The instructions further cause the one or more processors to receive subsequent sensor data from the one or more sensors. The instructions further cause the one or more processors to compare the predicted sensor data to the subsequent sensor data to generate one or more reconstruction errors. The instructions further cause the one or more processors to apply the reconstruction error enhancement coefficients to the one or more reconstruction errors to generate one or more enhanced reconstruction errors. The instructions further cause the one or more processors to determine that the building system has a refrigerant leakage based on the one or more enhanced reconstruction errors. The instructions further cause the one or more processors to, responsive to determining that the HVAC system has the refrigerant leakage, take an action to address the refrigerant leakage.

Another implementation of the present disclosure is a method for refrigerant leakage detection. The method comprises receiving, by one or more processors of a system, sensor data from one or more sensors associated with a building system including a refrigerant. The method further comprises applying, by the one or more processors, the sensor data to a machine learning model to generate predicted sensor data corresponding to the one or more sensors. The method further comprises receiving, by the one or more processors, subsequent sensor data from the one or more sensors. The method further comprises comparing, by the one or more processors, the predicted sensor data to the subsequent sensor data. The method further comprises determining, by the one or more processors, that the building system has a refrigerant leakage based on the comparison of the predicted sensor data to the subsequent sensor data. The method further comprises, responsive to determining that the building system has the refrigerant leakage, taking, by the one or more processors, an action to address the refrigerant leakage.

Those skilled in the art will appreciate that the summary is illustrative only and is not intended to be in any way limiting. Other aspects, inventive features, and advantages of the devices and/or processes described herein, as defined solely by the claims, will become apparent in the detailed description set forth herein and taken in conjunction with the accompanying drawings.

BRIEF DESCRIPTION OF THE DRAWINGS

Various objects, aspects, features, and advantages of the disclosure will become more apparent and better understood by referring to the detailed description taken in conjunction with the accompanying drawings, in which like reference characters identify corresponding elements throughout. In the drawings, like reference numbers generally indicate identical, functionally similar, and/or structurally similar elements.

FIG. 1A shows a schematic component block diagram of a system, according to an exemplary embodiment.

DETAILED DESCRIPTION

Figure 1B:
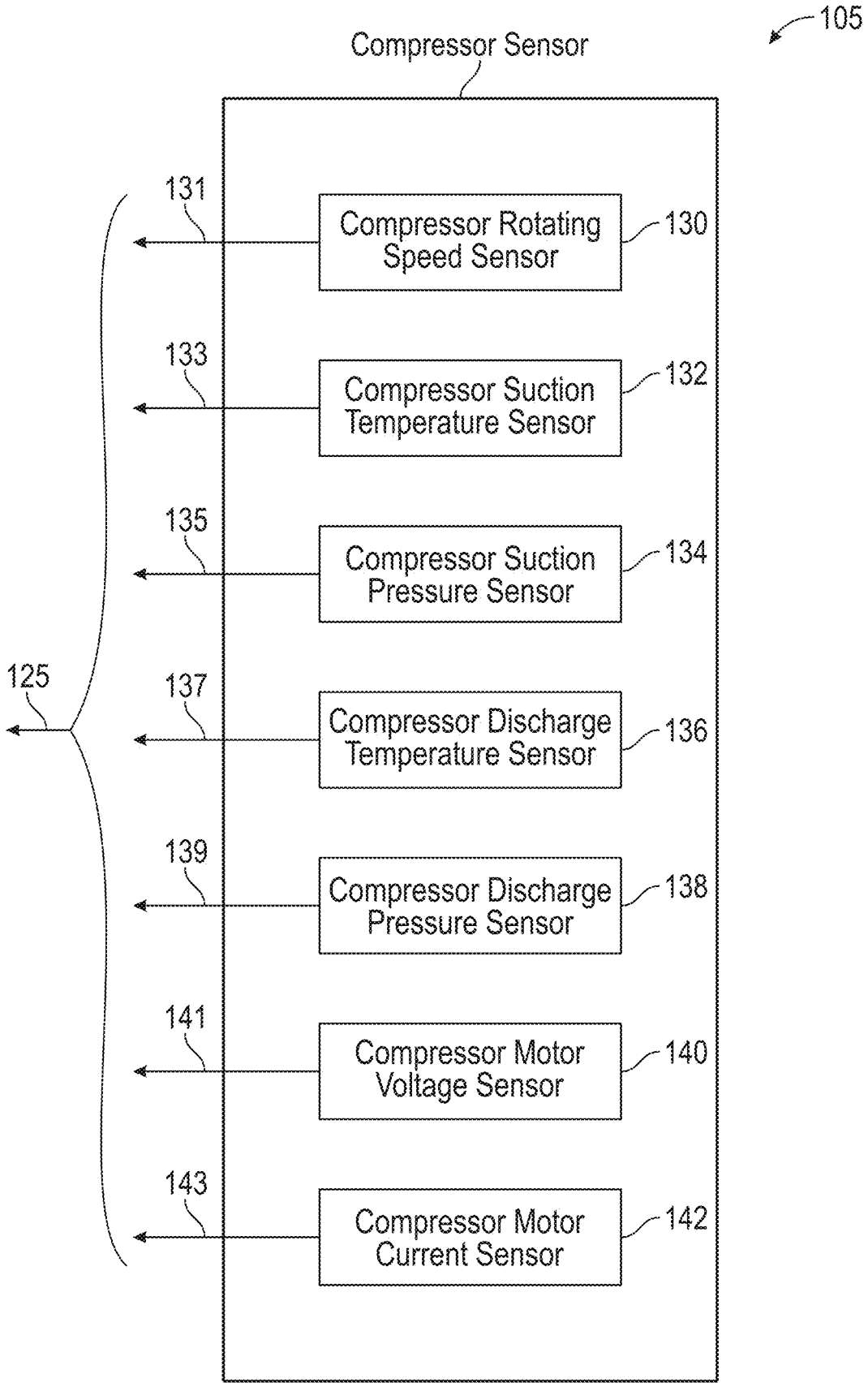
FIG. 1B shows structural details of a compressor sensor of the system of FIG. 1A, according to an exemplary embodiment.

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

Refrigerant Leakage Detection

FIG. 1A shows a schematic component block diagram of a heat transfer system 100 configured to circulate a refrigerant, according to an example embodiment. In some instances, the heat transfer system 100 is or includes one or more of a heating, cooling, and/or air conditioning (HVAC) system, a chiller or chiller unit, an air-conditioning unit, or any other suitable type of system for transferring heat using one or more refrigerant circuits. As shown in FIG. 1A, the heat transfer system 100 includes a compressor 104, a condenser 106, a condenser fan 117, a throttle valve 108, an evaporator 110, a chilled water pump 112, a thermal load 114, and a controller 116. The condenser fan 117 performs air cooling on the condenser 106. The heat transfer system 100 shown in FIG. 1A has a refrigerant circulation loop 101 and a chilled water circulation loop 102.

Referring to FIG. 1A, the refrigerant circulation loop 101 is sequentially connected to the compressor 104, the condenser 106, the throttle valve 108, and the evaporator 110. A discharge port of the compressor 104 is in fluid communication with an inlet of the condenser 106, an outlet of the condenser 106 is in fluid communication with an inlet of the throttle valve 108, an outlet of the throttle valve 108 is in fluid communication with an inlet of the evaporator 110, and an outlet of the evaporator 110 is in fluid communication with a suction port of the compressor 104. A refrigerant is compressed to be in a high-pressure and high-temperature state in the compressor 104 and then discharged into the condenser 106; then the refrigerant exchanges heat with ambient air in the condenser 106 to release heat so as to be condensed to be in a high-pressure and liquid state; then it is discharged into the throttle valve 108; in the throttle valve 108, the refrigerant is expanded and throttled to be in a low-pressure and two-phase state, and then flows into the evaporator 110; and then the refrigerant exchanges heat with chilled water in the evaporator 110 to absorb heat so as to be evaporated to be in a low-pressure and gaseous state, and then returns to the compressor 104 from the suction port of the compressor 104 to complete refrigerant circulation. The thermal load 114 is disposed in an environment 118. The controller 116 is respectively connected with the compressor 104, the condenser 106, the throttle valve 108, the evaporator 110 and the chilled water pump 112, is used to control the compressor 104, the condenser 106, the throttle valve 108, the evaporator 110 and the chilled water pump 112, and is used to collect parameters from of a compressor sensor 105, a condenser sensor 107, a throttle valve sensor 109, and an evaporator sensor 111 of the compressor 104, the condenser 106, the throttle valve 108, and the evaporator 110, respectively Still referring to FIG. 1A, the chilled water circulation loop 102 is sequentially connected to the evaporator 110, the chilled water pump 112, and the thermal load 114. The chilled water pump 112 is used to drive the chilled water to make it circulate to flow through the thermal load and the evaporator, so that the chilled water exchanges heat with the refrigerant in the evaporator 110. In the chilled water circulation loop 101, while the refrigerant absorbs heat in the evaporator 110 so as to be evaporated, the chilled water releases heat to be cooled. The cooled chilled water flowing through the thermal load 114 will take away the heat of the thermal load, so that the thermal load 114 is cooled, and the ambient air in the environment 118 is refrigerated.

In order to collect various parameters in the heat transfer system 100, according to an example embodiment, 5 types of sensors are disposed in the heat transfer system 100, including: (1) a compressor sensor 105, (2) a condenser sensor 107, (3) a throttle valve sensor 109, (4) an evaporator sensor 111, and (5) an environmental sensor 113. As described herein, an output 125 of the compressor sensor 105, an output 127 of the condenser sensor 107, an output 129 of the throttle valve sensor 109, an output 121 of the evaporator sensor 111 and an output 123 of the environmental sensor 113 are connected to the controller 116, to provide the sensor parameters to the controller 116, and the combined use of these sensor parameters enables the controller 116 to diagnose system refrigerant leakage more effectively, more accurately, and more sensitively.

In some embodiments, positions of the various sensors are disposed as follows: (1) the compressor sensor 105 is disposed inside or near the compressor 104; (2) the condenser sensor 107 is disposed inside or near the condenser 106; (3) the throttle valve sensor 109 is disposed inside or near the throttle valve 108; (4) the evaporator sensor 111 is disposed inside or near the evaporator 110; and (5) the environmental sensor 113 is disposed in the use environment 118 of the heat transfer system 100.

Still referring to FIG. 1A, in some embodiments, the heat transfer system 100 further comprises a refrigerant pump 186 and a refrigerant container 188, wherein the refrigerant container 188 is used to store a refrigerant medium, and the refrigerant medium is provided or recovered to the refrigerant circulation loop 101 through the refrigerant pump 186. Further, the controller 116 can control the refrigerant pump 186 to be turned on and off, so that the refrigerant container 188 can provide different refrigerant charging amounts to the heat transfer system 100 under the control of the controller 116.

FIGS. 1B-1F show structural details of the compressor sensor 105, the condenser sensor 107, the throttle valve sensor 109, the evaporator sensor 111, and the environmental sensor 113 in FIG. 1A. For example, as shown in FIG. 1B, in some embodiments, the compressor sensor 105 includes a compressor rotating speed sensor 130, a compressor suction temperature sensor 132, a compressor suction pressure sensor 134, a compressor discharge temperature sensor 136, a compressor discharge pressure sensor 138, a compressor motor voltage sensor 140, and a compressor motor current sensor 142. It will be appreciated that, in some embodiments, the compressor sensor 105 may include fewer or additional sensors, as desired for a given application. The compressor rotating speed sensor 130, the compressor suction temperature sensor 132, the compressor suction pressure sensor 134, the compressor discharge temperature sensor 136, the compressor discharge pressure sensor 138, the compressor motor voltage sensor 140, and the compressor motor current sensor 142, respectively, have a sensor output 131, a sensor output 133, a sensor output 135, a sensor output 137, a sensor output 139, a sensor output 141, and a sensor output 143, which are connected to the controller 116. For ease of illustration, the sensor output 131, the sensor output 133, the sensor output 135, the sensor output 137, the sensor output 139, the sensor output 141, and the sensor output 143 are collectively identified as a sensor output 125.

Figure 1C:
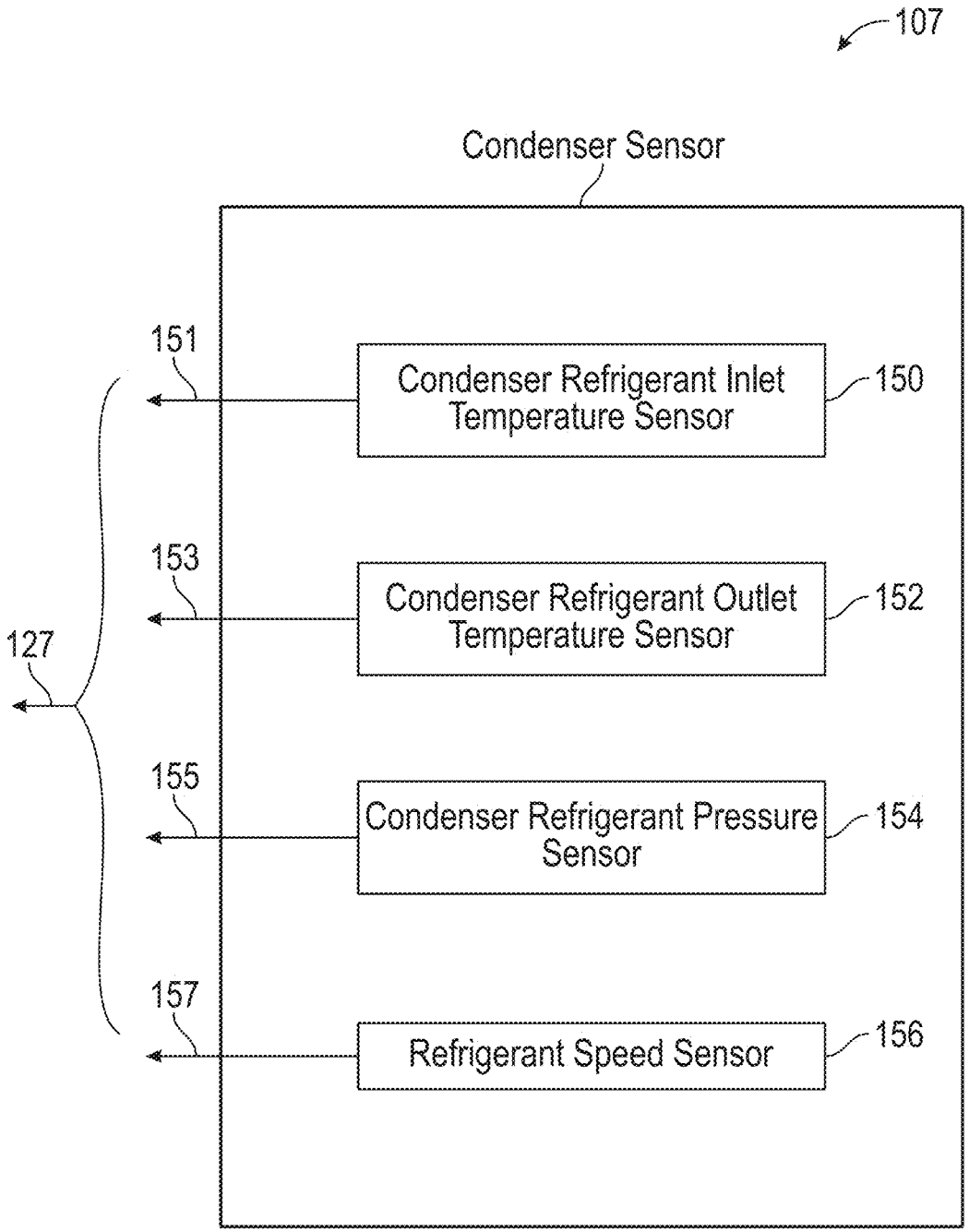
FIG. 1C shows structural details of a condenser sensor of the system of FIG. 1A, according to an exemplary embodiment.

As shown in FIG. 1C, in some embodiments, the condenser sensor 107 includes a condenser refrigerant inlet temperature sensor 150, a condenser refrigerant outlet temperature sensor 152, a condenser refrigerant pressure sensor 154, and a refrigerant speed sensor 156. The condenser refrigerant inlet temperature sensor 150, the condenser refrigerant outlet temperature sensor 152, the condenser refrigerant pressure sensor 154, and the refrigerant speed sensor 156, respectively, have a sensor output 151, a sensor output 153, a sensor output 155, and a sensor output 157, which are connected to the controller 116. For ease of illustration, the sensor output 151, the sensor output 153, the sensor output 155 and the sensor output 157 are collectively identified as a sensor output 127.

Figure 1D:
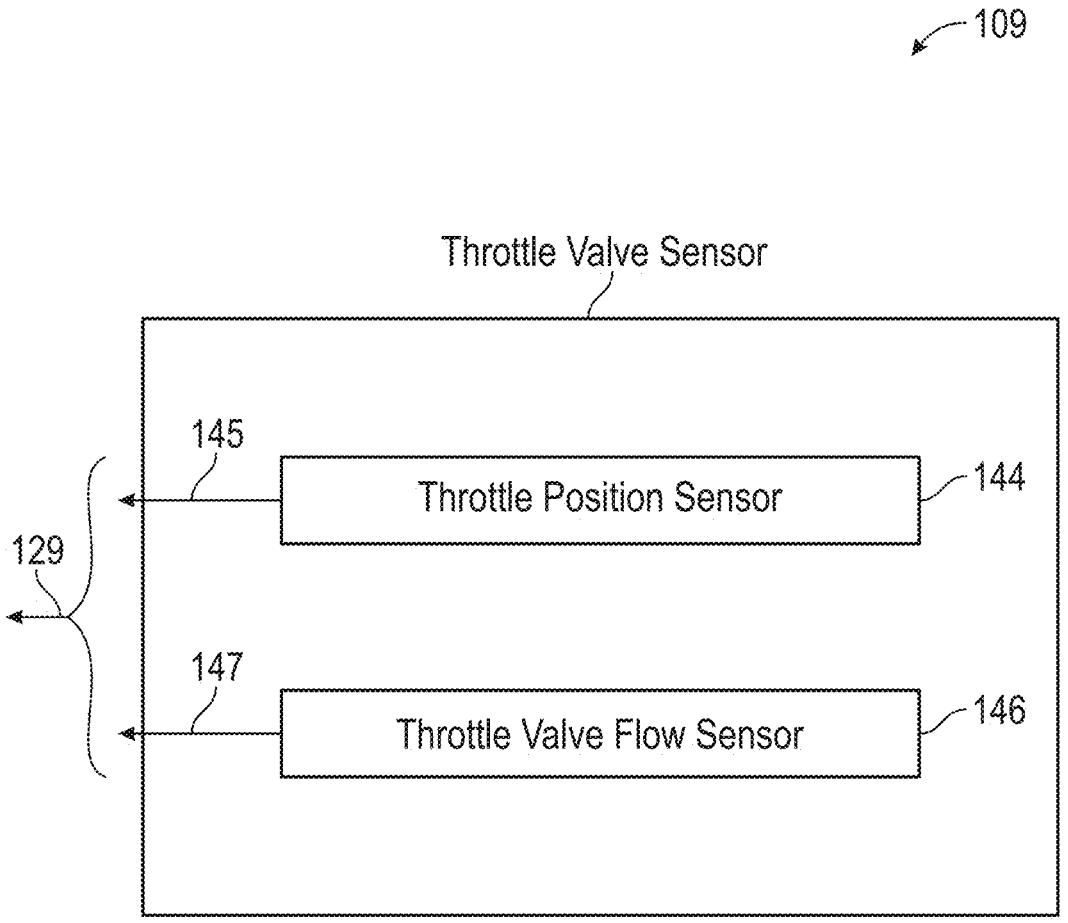
FIG. 1D shows structural details of a throttle valve sensor of the system of FIG. 1A, according to an exemplary embodiment.

As shown in FIG. 1D, in some embodiments, the throttle valve sensor 109 includes a throttle position sensor 144 (e.g., a sensor configured to sense a degree to which the throttle opened) and a throttle valve flow sensor 146. The throttle valve opening degree sensor 144 and the throttle valve flow sensor 146, respectively, have a sensor output 145 and a sensor output 147, which are connected to the controller 116. For ease of illustration, the sensor output 145 and the sensor output 147 are collectively identified as a sensor output 129.

Figure 1E:
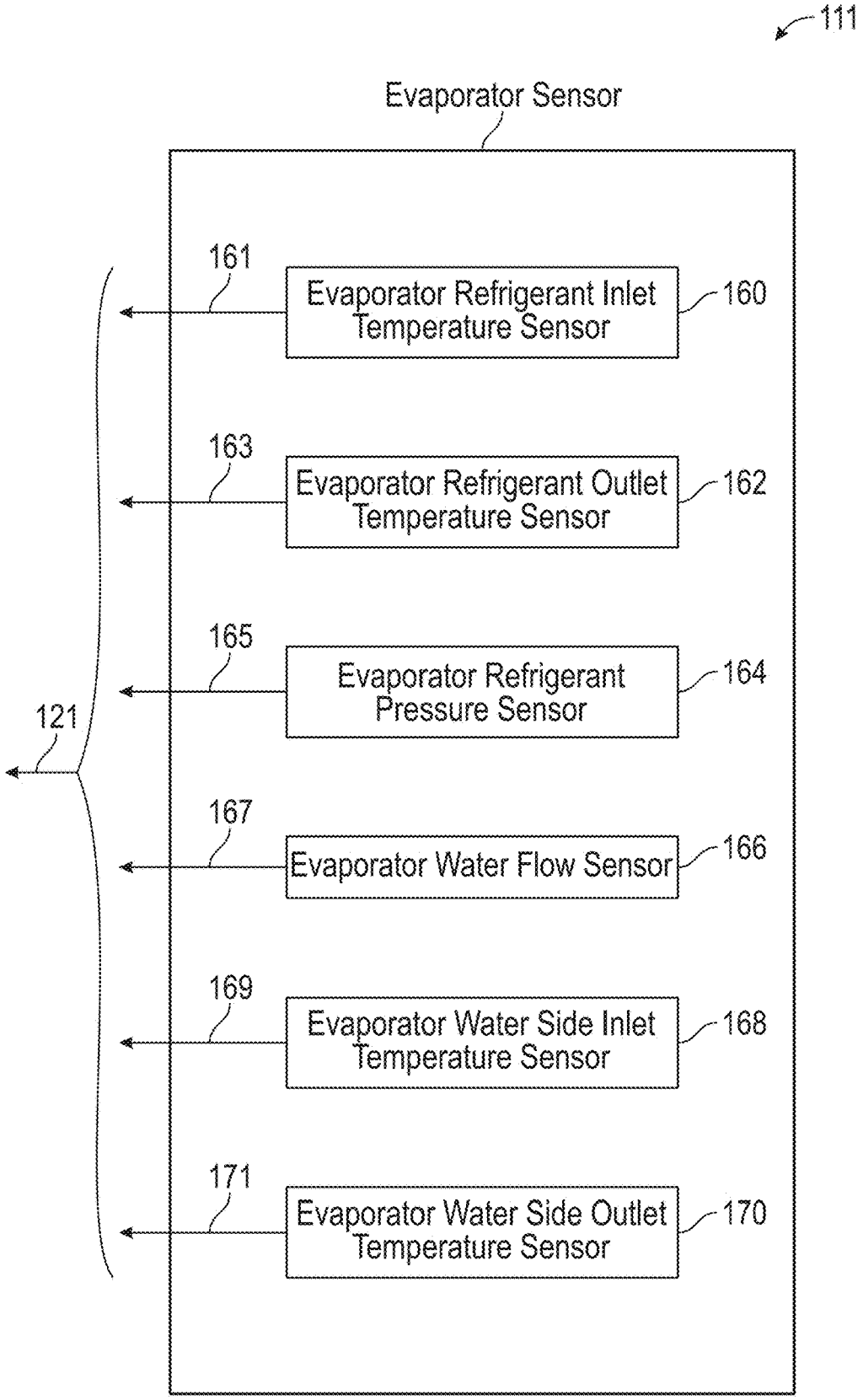
FIG. 1E shows structural details of an evaporator sensor of the system of FIG. 1A, according to an exemplary embodiment.

As shown in FIG. 1E, in some embodiments, the evaporator sensor 111 includes an evaporator refrigerant inlet temperature sensor 160, an evaporator refrigerant outlet temperature sensor 162, an evaporator refrigerant pressure sensor 164, an evaporator water flow sensor 166, an evaporator water side inlet temperature sensor 168, and an evaporator water side outlet temperature sensor 170. The evaporator refrigerant inlet temperature sensor 160, the evaporator refrigerant outlet temperature sensor 162, the evaporator refrigerant pressure sensor 164, the evaporator water flow sensor 166, the evaporator water side inlet temperature sensor 168, and the evaporator water side outlet temperature sensor 170, respectively, have a sensor output 161, a sensor output 163, a sensor output 165, a sensor output 167, a sensor output 169, and a sensor output 171, which are connected to the controller 116. For ease of illustration, the sensor output 161, the sensor output 163, the sensor output 165, the sensor output 167, the sensor output 169, and the sensor output 171 are collectively identified as a sensor output 121.

Figure 1F:
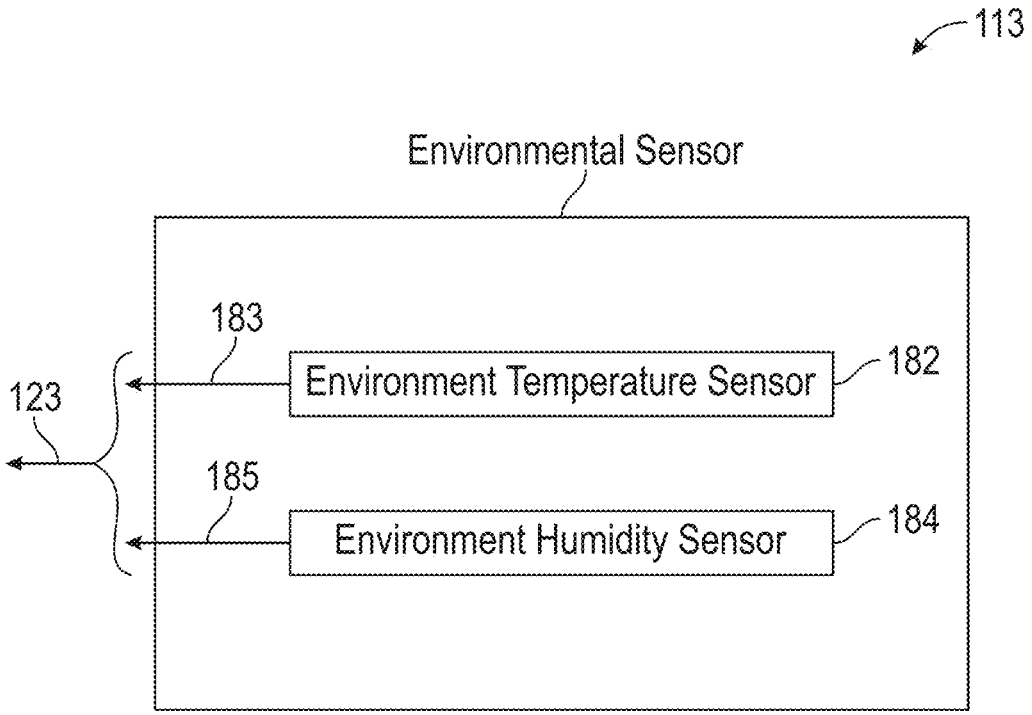
FIG. 1F shows structural details of an environmental sensor of the system of FIG. 1A, according to an exemplary embodiment.

As shown in FIG. 1F, in some embodiments, the environmental sensor 113 includes an environment temperature sensor 182 and an environment temperature sensor 184. The environment temperature sensor 182 and the environment temperature sensor 184, respectively, have a sensor output 183 and a sensor output 185, which are connected to the controller 116. For ease of illustration, the sensor output 183 and the sensor output 185 are collectively identified as a sensor output 123.

Figure 2A:
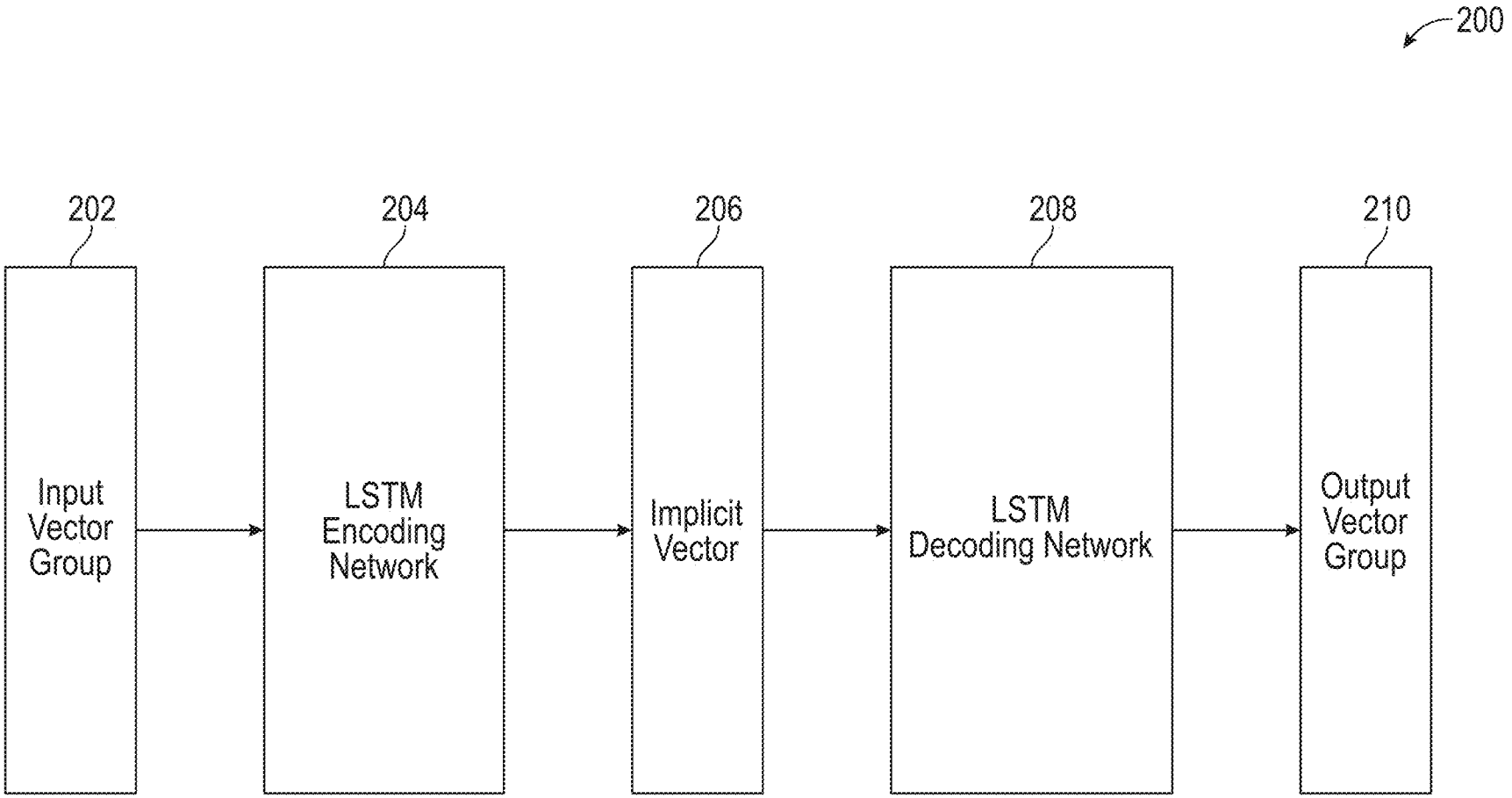
FIG. 2A shows a schematic block diagram of an LSTM detection model, according to an exemplary embodiment.

FIG. 2A shows a schematic block diagram of a working principle of a Long Short-Term Memory (LSTM) detection model 200, according to an example embodiment. This model is described in a paper by Hoang Duy Trinh et al. in IEEE (H. D. Trinh et al.: Detecting Mobile Traffic Anomalies Through Physical Control Channel, IEEE Access, VOLUME 7, 2019) in 2019, the entirety of which is incorporated by reference herein.

As shown in FIG. 2A, the LSTM detection model 200 includes an input vector group module 202, an LSTM encoding network module 204, an implicit vector 206, an LSTM decoding network module 208, and an output vector group module 210.

The input vector group module 202 converts data collected by the k sensors into an input vector group. The LSTM encoding network module 204 compresses the input vector group into the implicit vector 206. The implicit vector 206 is an intermediate vector between the encoding performed by the LSTM encoding network module 204 and the decoding performed by the LSTM decoding network module 208. For example, the LSTM encoding network module 204 compresses the input vector group from the input vector group module 202 into the implicit vector 206, and the LSTM decoding network module 208 uses the implicit vector 206 as an input and restores it to a second input vector group, that is, an adjacent subsequent vector group to the first input vector group, as the output vector group 210.

Figure 2B:
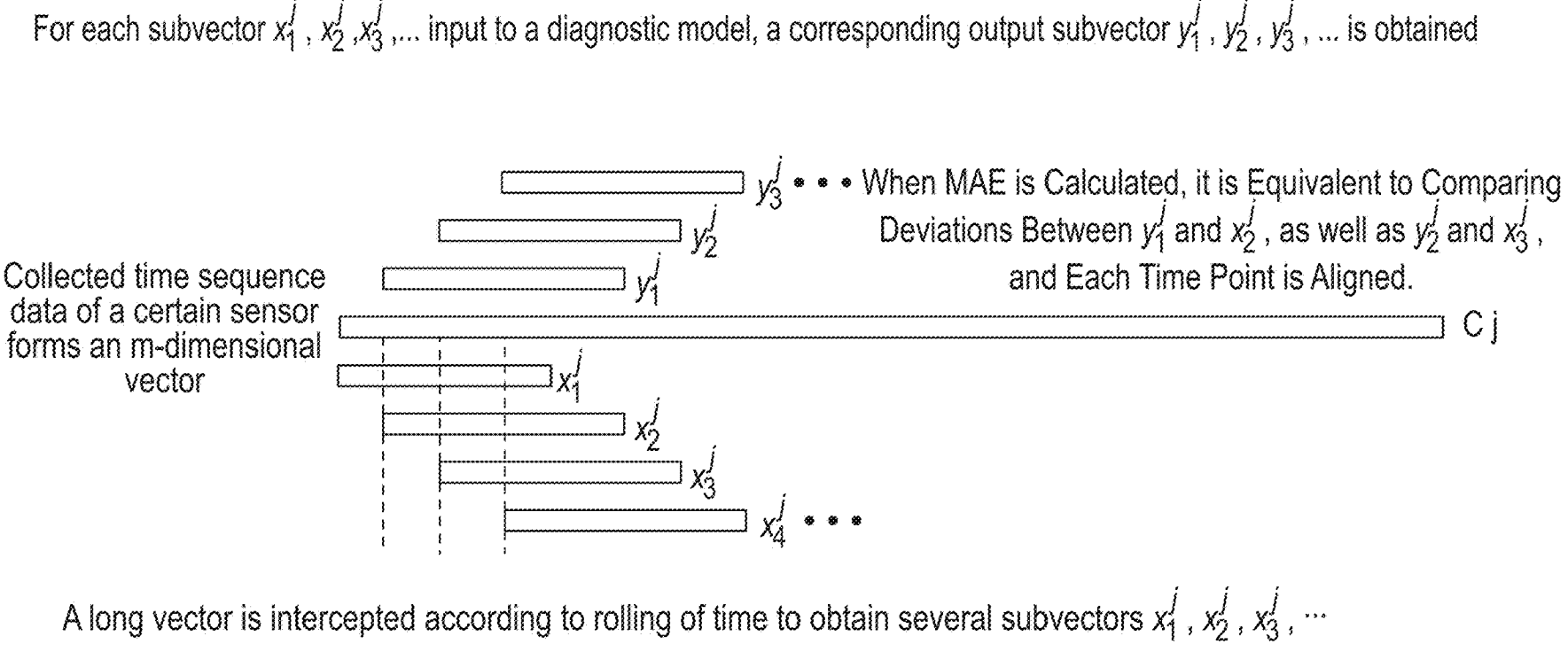
FIG. 2B shows a format of input data in the LSTM detection model in FIG. 2A, according to an exemplary embodiment.

FIG. 2B shows a format of input data in the LSTM detection model in FIG. 2A, including test data sequences, division of subvectors, and time-rolling characteristics of the subvectors.

In the LSTM detection model shown in FIG. 2B, it is assumed that a heat transfer system that circulates refrigerant (e.g., similar to the heat transfer system 100) has k sensors, and each sensor j (j=1, 2, . . . , k) collects unit data according to a time period. Therefore, after m unit time periods (for example, 10,000 unit time periods), m pieces of unit data are arranged into data test data sequences Cj arranged in a periodic manner, wherein each test data sequence Cj comprises sequence elements $$c_i^j,$$

wherein i=1, 2, . . . , m, and m represents a number of data points obtained from a combination test according to a sampling period.

In order to use the LSTM detection model to perform refrigerant leakage diagnosis on the heat transfer system, as described herein, several input subvectors are intercepted (e.g., by the controller 116) from the test data sequence Cj corresponding to each sensor k on a rolling, periodic basis $$(e.g., x_1^j, x_2^j, x_3^j, \ldots),$$

so that there are n vector elements in each input subvector (or an n-dimensional vector, wherein n<m). Each of the n-dimensional input subvectors has i (i=1, 2, . . . , n) vector elements, namely $$x_i^j (j = 1, 2, \ldots, k; i = 1, 2, \ldots, n).$$

It should be noted that, for the input subvectors, i (i=1, 2, . . . , n) has two meanings: (1) i is a second subscript value, indicating the periodic time position of each vector element in the input x subvectors in the data test data sequences Cj, and (2) the position of the i subscript value further indicates the position of each vector element in the input subvectors.

After the input vector group module 202 receives the n-dimensional input subvectors $$x_1^j, x_2^j, x_3^j, \ldots,$$

several output subvectors are generated using an LSTM detection model (e.g., the LSTM detection model 200), namely $$y_1^j, y_2^j, y_3^j, \ldots.$$

It should be noted that, for the output subvectors, i (i=1, 2, . . . , n) has two meanings: (1) i is a second subscript value, indicating the periodic time position of each vector element in the output x subvectors in the data test data sequences Cj, and (2) the position of the i subscript value further indicates the position of each vector element in the output x subvectors.

As shown in FIG. 2B, a comparison relationship between the input subvectors and the corresponding output subvectors is as follows:

$$(y_1^j \text{ and } x_2^1), (y_2^j \text{ and } x_3^j), (y_3^j \text{ and } x_4^j),$$

are compared to obtain the deviations between them, and then these deviations are used to calculate reconstruction errors (which also may be referred to as reconstruction losses or reduction deviations), as will be described in detail below.

Figure 2C:
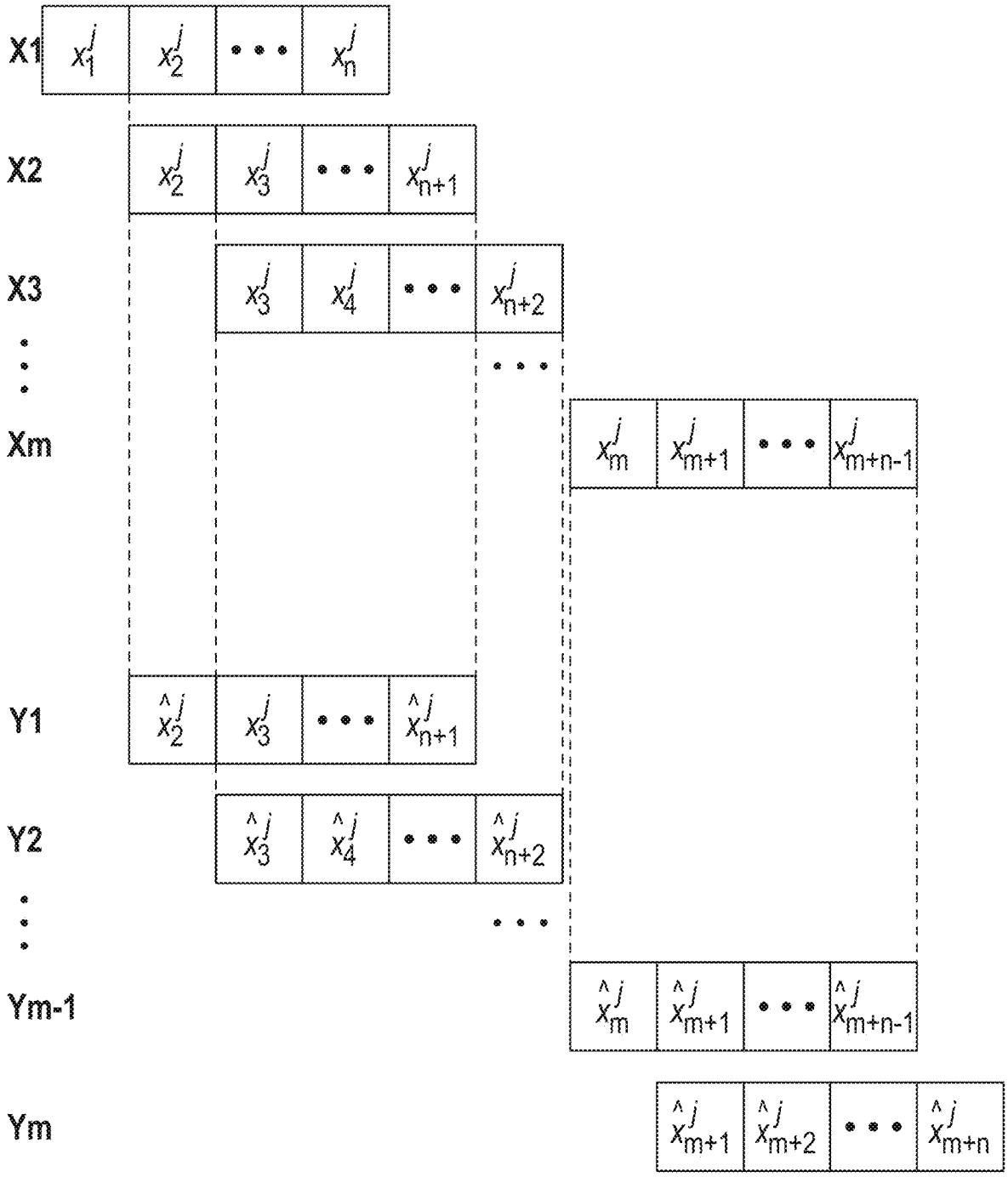
FIG. 2C shows a data format of input subvectors and output subvectors generated by a sensor in the LSTM detection model in FIG. 2A, according to an exemplary embodiment.

FIG. 2C shows a data format of the input subvectors and output subvectors generated by sensors j (j=1, 2, . . . , k) in the LSTM detection model 200 in FIG. 2A.

As shown in FIG. 2C, the vector elements $$x_{i+1}^j$$

in a subsequent input vector are rolled backward by one period relative to the vector elements $$x_i^j$$

in the previous input vector, and the vector elements $$y_{i+1}^j$$

in a subsequent output vector are rolled backward by one period relative to the vector elements $$y_i^j$$

in the previous output vector. In the LSTM model 200, the input subvectors $$x_{i+1}^j$$

and the output subvectors $$y_i^j$$

are aligned in time periods.

Figure 3:
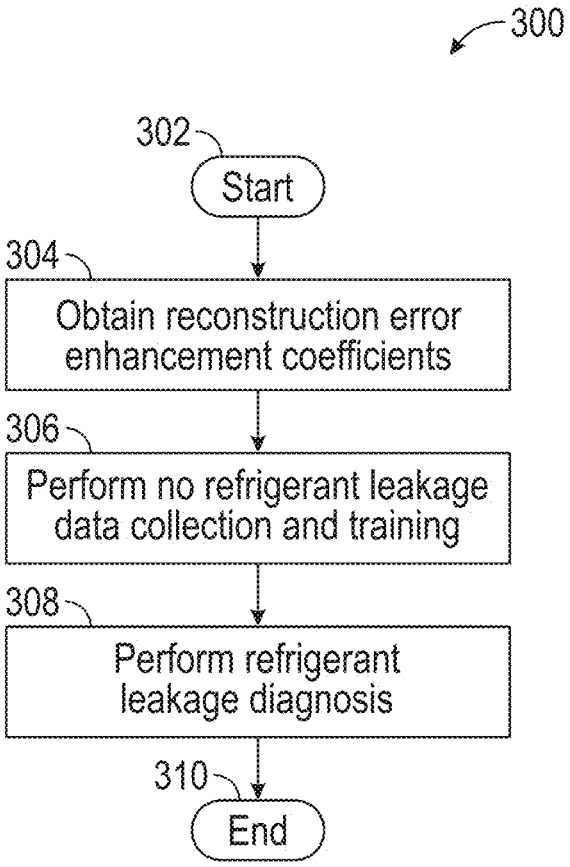
FIG. 3 shows a flow block diagram of a method for diagnosing refrigerant leakage of the system, according to an exemplary embodiment.

FIG. 3 shows a flow block diagram of a method 300 for diagnosing refrigerant leakage of the heat transfer system 100, according to an example embodiment. In some embodiments, as shown in FIG. 3, in step 304, the controller 116 performs an operation of obtaining reconstruction error enhancement coefficients. In some embodiments, the controller 116 further performs the operation of obtaining test threshold proportional coefficients.

In some embodiments, functions of step 304 include enhancing the sensitivity of parameters related to refrigerant leakage and separating refrigerant leakage from other failures. For example, as will be described in detail below, in some instances, the controller 116 may use a combination test under different refrigerant charging amounts that includes data collection, data cleaning, normalization, correlation analysis, sensitivity analysis, input amount screening, multiple linear regression, training the LSTM model, and obtaining test thresholds and test threshold proportional coefficients.

For example, in some embodiments, an operating structure of the heat transfer system is an apparatus that realizes refrigeration or heating through a vapor compression circulation. A refrigerant is a medium charged and circulated within the heat transfer system. In some embodiments, the refrigerant utilized may comprise one or more of R22, R32, R410a, R134a, R1234ze, R515B, etc. However, the leak detection described herein is suitable for leak detection of these refrigerants as well as any other suitable types of refrigerants.

Refrigerant leakage results in a variety of technical problems. One technical problem encountered within a heat transfer system when refrigerant leakage occurs is that changes in the refrigerant charging amounts will have a global impact on the heat transfer system. For example, after the refrigerant is overcharged, the static (base) pressure in the loop is high, thereby affecting drift of the phase transition temperature of the evaporator and the condenser, and affecting the refrigeration, heating, and/or overall performance of the heat transfer system. At the same time, the slightly high suction pressure will also cause an operating point of the compressor to shift in an efficiency map. Accordingly, changes in the performance of the components will cause system control logic to drive the components to make new adjustments, which may have a variety of additional impacts. Further, after the refrigerant leaks, the heat transfer system may have a variety of problems, such as a decrease in refrigeration/heating capacity, high power consumption, low suction pressure, and, in some instances, an alarm on the suction pressure.

Another technical problem encountered when refrigerant leakage occurs is that the performance of the heat transfer system deteriorates. However, refrigerant leakage is only one of the potential factors that could lead to performance deterioration. Other factors may include an excessive fouling coefficient in the condenser or evaporator, dirty blockage (e.g., accumulation of catkins or other natural particulates often occurring in early spring in the northern region) on the air side of an air-cooled heat exchanger, abnormalities in the electronic expansion valve, etc. In some instances, multiple failures and/or factors occur at the same time, which may exacerbate the heat transfer system deterioration.

The refrigerant leak detection methods described herein (e.g., via method 300 and utilizing the LSTM model 200) solve the above two problems, in part, by finding sensitive features (e.g., features that are particularly sensitive to refrigerant leakage) from a large number of system sensor parameters and by effectively separating refrigerant leakage from other failure factors. For example, in operation, for each sensor parameter, the step of obtaining the reconstruction error enhancement coefficient (e.g., $\beta_1, \beta_2, \ldots, \beta_k$) of each sensor is performed, and some parameters in the obtained reconstruction error enhancement coefficients (e.g., $\beta_1, \beta_2, \ldots, \beta_k$) are very close to zero. That is, the sensor parameters having the very low (e.g., very close to zero) reconstruction error enhancement coefficients are not related to the refrigerant leakage amounts. Accordingly, for these irrelevant (or largely irrelevant) proportional coefficients, they are removed from consideration (or given a correspondingly low weighting in subsequent calculations). Thus, as described herein, the methods described herein effectively retain and/or provide a proportionally higher weighting to sensor parameters related to (or highly indicative of) refrigerant leakage, while effectively removing and/or providing proportionally lower weighting to sensor parameters that are not related to (or otherwise not highly indicative of) refrigerant leakage.

After the operation of step 304 is completed, the operation goes to step 306. As will be described in detail below, in step 306, the controller 116 performs operations of no refrigerant data collection and training. Step 306 is performed to collect the heat transfer system parameters under the condition of no refrigerant leakage diagnosis, perform training on the collected heat transfer system parameters, and diagnose the threshold values according to the obtained reconstruction error enhancement coefficients.

After the operation of step 306 is completed, the operation proceeds to step 308. As will be described in detail below, in step 308, the controller 116 performs an operation of online refrigerant leakage diagnosis. In the execution of step 308, the controller 116 first obtains the enhanced reconstruction errors, then provides a leakage condition of a diagnosis system according to the enhanced reconstruction errors, and sends a diagnostic report.

After the operation of step 308 is completed, the operation goes to step 310, and the flow 300 ends.

Figure 4:
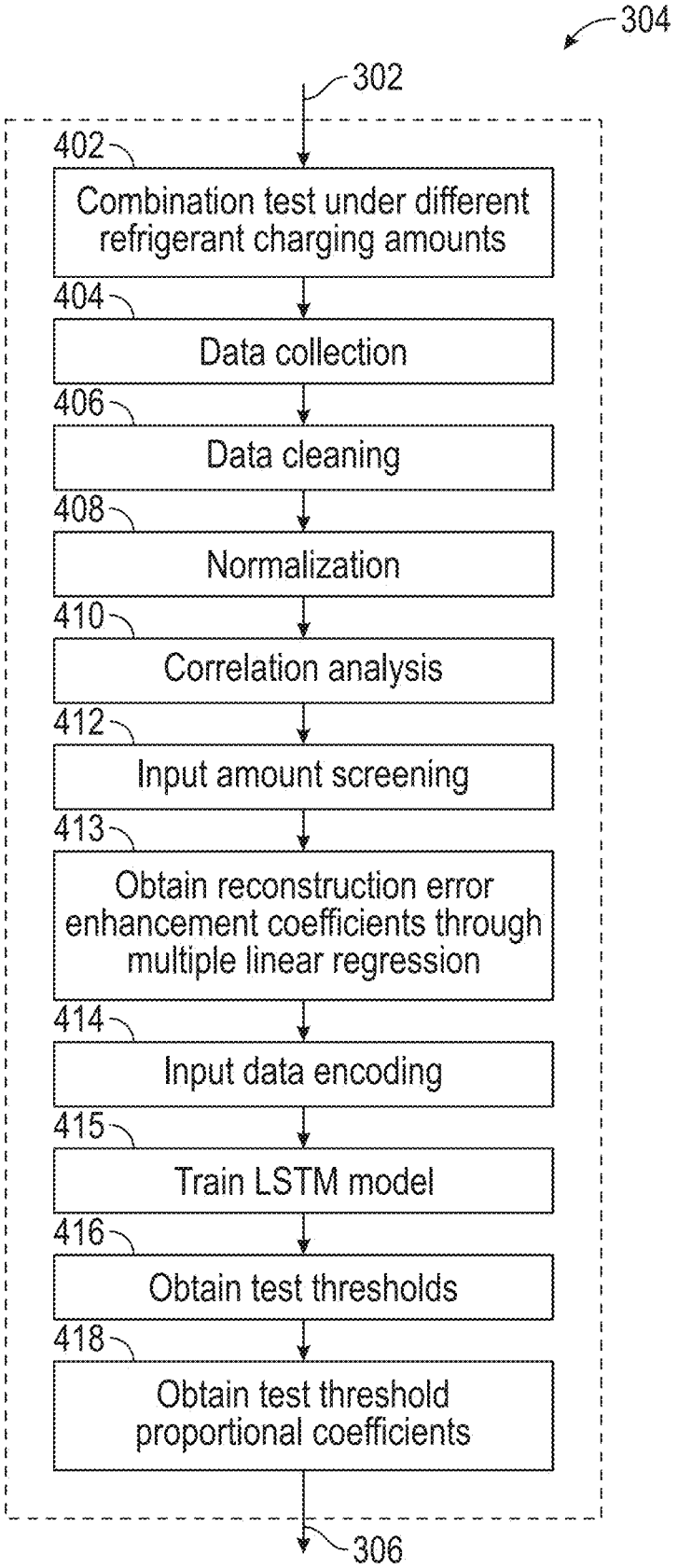
FIG. 4 shows a detailed example of one step in the flow block diagram shown in FIG. 3, according to an exemplary embodiment.

FIG. 4 shows a detailed example of step 304 from the flow block diagram 300 shown in FIG. 3, according to an example embodiment. As shown in FIG. 4, in step 402, the controller 116 conducts test operations under combinations of different refrigerant charging amounts and/or different refrigeration conditions (e.g., a GB refrigeration condition, an air conditioning, heating, and refrigeration institution (AHRI) condition, an integrated part load value (IPLV) refrigeration condition).

For obtaining the reconstruction error enhancement coefficients, multiple tests are set up. In some embodiments, each new model of heat transfer system (e.g., an HVAC system, a chiller, an air-conditioning unit) is tested under 100% of the refrigerant charging amounts according to AHRI and/or GB tables. As such, the existing test scheme makes full use of the test data when IPLV (Integrated Part-Load Value) is obtained. However, using only the 100% charging amounts does not allow for obtaining the reconstruction error enhancement coefficients. Accordingly, in some embodiments, tests under 95%, 90%, and 85% of the refrigerant charging amounts are additionally utilized. Such setting also makes full use of the design techniques for partial load conditions in the GB standard (GB/T10870) and the AHRI standard (AHRI Standard 550/590). These two standards put forward 4 gears (e.g., speeds, levels, charging amounts) based on the statistical analysis of the actual operating conditions of a large number of customer units. Combining these 4 gears can better estimate the actual operating state of a given heat transfer system (e.g., an HVAC system, a chiller, an air-conditioning unit). Therefore, performing refrigerant leakage simulation under these 4 gears is equivalent to using fewer test resources to obtain state parameters that are closer to the user's actual application (that is, parameters that reflect the state of the unit, such as temperature, pressure, flow, power, etc.). As such, more effective reconstruction error enhancement coefficients can be obtained with fewer test resources.

As one embodiment, in step 402, there are several (such as, 4) options for changing combinations of the refrigerant charging amounts. In some embodiments, the several different refrigerant charging amounts comprise no leakage, a first leakage amount, a second leakage amount, and a third leakage amount. In some instances, these refrigerant charging amounts have corresponding values of 100%, 95%, 90%, and 85%, respectively, where 100% means that the unit has no leakage and the refrigerant charging amount is in a factory state; 95% means that the refrigerant is leaked by 5% of the standard charging amount; 90% means that the refrigerant is leaked by 10% of the standard charging amount; and 85% means that the refrigerant is leaked by 15% of the standard charging amount.

After the operation of step 402 is completed, the operation goes to step 404. In step 404, the controller 116 performs a data collection operation. Specifically, in step 404, for the 4 kinds of refrigerant charging amounts and for 4 working state combinations of each charging amount, at the 2 refrigeration standards (taking the AHRI refrigeration condition and the GB refrigeration standard as an example), there are total 16 test points under combination for an operation of data collection. Based on these 16 test points, the corresponding sensors in FIG. 1 perform prediction data collection on these 16 test points. The following Table 1 and Table 2 each show 4 gear states, which are as follows:

TABLE 1

| AHRI standard refrigeration conditions | | | | |
|---|---|---|---|---|
| Water-cooled evaporator | | | Air-cooled condenser | |
| Inlet water temperature (° C.) | Outlet water temperature (° C.) | Water flow m^3/(h-kW) | Load ratio (%) | Environment temperature (° C.) |
| A | 6.7 | 0.160808696 | 100 | 35.0 |
| ~(A − 6.7)*0.75 + 6.7 | 6.7 | 0.160808696 | 75 | 26.7 |
| ~(A − 6.7)*0.5 + 6.7 | 6.7 | 0.160808696 | 50 | 18.3 |
| ~(A − 6.7)*0.25 + 6.7 | 6.7 | 0.160808696 | 25 | 12.8 |

TABLE 2

| GB standard refrigeration conditions | | | | |
|---|---|---|---|---|
| Water-cooled evaporator | | | Air-cooled condenser | |
| Inlet water temperature (° C.) | Outlet water temperature (° C.) | Water flow m^3/(h-kW) | Load ratio (%) | Environment temperature (° C.) |
| 12 | 7 | 0.172 | 100% | 35 |
| ~10.75 | 7 | 0.172 | 75% | 31.5 |
| ~9.5 | 7 | 0.172 | 50% | 28 |
| ~8.25 | 7 | 0.172 | 25% | 24.5 |

In the AHRI standard, the standard refrigeration condition only clearly mentions that the outlet water temperature of the evaporator is 44° F. (6.7° C.), and the inlet temperature is determined by 100% of the designed refrigeration capacity. Therefore, the inlet temperature is assumed to be A in Table 1, so A is a to-be-determined value that needs to be calculated.

The operation of data collection in step 404 is now described in conjunction with FIG. 2B. In step 404, it is assumed that there are j sensors, wherein j=1, 2, . . . , k. Each sensor j will collect a test data sequence Cj (j=1, 2, . . . , k) as shown in FIG. 2B.

After the operation of step 404 is completed, the operation goes to step 406. In step 406, the controller 116 performs an operation of data cleaning on the data collected by the sensors. The purpose of the operation of data cleaning is to remove the response delay caused by short-term fluctuations in the predicted data collected by the sensors, because these delayed data will affect the effectiveness of the reconstruction error enhancement coefficients.

After the operation of step 406 is completed, the operation goes to step 408. After the data cleaning is completed in step 406, the controller 116 performs an operation of data normalization on the predicted data collected by the sensors, at step 408. The purpose of the operation of data normalization is the advantage of normalizing the predicted data collected by the sensors to avoid the interference of the digital unit or magnitude on the stability of subsequent data calculation and analysis.

In some embodiments, the normalization method is extreme value normalization. That is, each piece of data is adjusted to [0,1] by using a maximum value and a minimum value in a collection data set. For the element $x_i$ in $[x_1, x_2, \ldots, x_n]$, a calculation method of obtaining an extreme value result $x'_i$ is as follows:

$$x'_i = \frac{x_i - x_{min}}{x_{max} - x_{min}}.$$

After the operation of step 408 is completed, the operation goes to step 410. In step 410, the controller 116 performs a data correlation analysis operation. The purpose of the operation of data correlation analysis is to screen the parameters with better correlation with refrigerant leakage from other prediction parameters collected by the sensors.

In one example embodiment, the screening results (e.g., on a York brand water-cooled air conditioner) include: 1) compressor suction temperature, 2) compressor discharge temperature, 3) environment temperature, 4) evaporator inlet water temperature, 5) evaporator outlet water temperature, 6) expansion valve opening degree, 7) fan rotating speed, 8) compressor frequency, 9) compressor current, 10) condenser outlet refrigerant temperature, 11) evaporator inlet and outlet water temperature difference, 12) compressor suction and discharge temperature difference, 13) condenser inlet and outlet refrigerant temperature difference.

After the operation of step 410 is completed, the operation goes to step 412. In step 412, the controller 116 performs an operation of input volume screening. The purpose of the operation of input quantity screening is to find the parameters that are sensitive to the changes of refrigerant among all the sensor parameters. Due to the large number of sensors and the higher data collection frequency, directly storing and computing a large amount of data consumes storage space and computing resources, and the associated costs are high. Therefore, by screening the input volume, the input is streamlined, the cost of data storage is reduced, and the calculation speed is improved.

It should be noted that, while the operation steps 406-412 optimize the test data sequences Cj (j=1, 2, . . . , k) collected by the sensor j (j=1, 2, . . . , k) in step 404 (and in accordance with FIG. 2B), even if steps 406-412 are not executed (e.g., step 404 is directly transferred to step 413), this operation method (e.g., the method of obtaining reconstruction error enhancement coefficients 304) still provides improved results, which are also within the scope of the present disclosure.

After the operation of step 412 is completed, the operation goes to step 413. In step 413, the controller 116 performs an operation of multiple linear regression. The operation of multiple linear regression is used to obtain regression coefficients for each sensor, and the regression coefficients are used as reconstruction error enhancement coefficients. For the calculation method of the reconstruction error enhancement coefficients, it is characterized in that the normalized refrigerant charging amounts are used as dependent variables, and other normalized screening data are used as the independent variables, thereby establishing the function form as follows:

$$\hat{y}_i = \beta_0 + \beta_1 x_i^1 + \beta_2 x_i^2 + \ldots + \beta_k x_i^k,$$

wherein i represents one sample (such as 0 s, 10 s, 20 s, 30 s, . . . ), k represents that there are k independent variables (such as the number of sensors), and $\hat{y}_i$ represents a predicted value of the refrigerant charging amount at $i^{th}$ time.

The estimation method of multiple linear regression parameters usually adopts a least square method, the principle is to minimize the sum of squares of the difference between a measured value and an estimated value, and $y_i$ represents an actual value of the refrigerant charging amount at the $i^{th}$ time. For the sample i, the difference between the actual value and the estimated value is:

$$y_i - \hat{y}_i = y_i - (\beta_0 + \beta_1 x_i^1 + \beta_2 x_i^2 + \ldots + \beta_k x_i^k),$$

for all n samples, the formula for the sum of squares of the difference between the measured value and the estimated value is as follows:

$$Q = \Sigma_{i=1}^{n} [y_i - (\beta_0 + \beta_1 x_i^1 + \beta_2 x_i^2 + \ldots + \beta_k x_i^k)]^2,$$

and the principle of the least squares method is to find a set of coefficients $\beta_0, \beta_1, \ldots, \beta_k$ to minimize Q. The corresponding wrapper functions of Matlab and Python scikit-learn can be used to calculate multiple regression coefficients. The regression coefficients $\beta_1, \beta_2, \ldots, \beta_k$ are the reconstruction error enhancement coefficients β to be used later. The reconstruction error enhancement coefficients obtained in one example embodiment are as following Table 3:

TABLE 3

| Variable Name | Enhancement Factor (β) |
|---|---|
| Tcomp_suc | −1.46E−17 |
| Tcomp_dis | 0.001306597 |
| Tedb | 0.140574632 |
| Twater_in | −0.001358681 |
| Twater_out | 0.001219534 |
| EXV | 6.80E−18 |
| Speed_fan | −2.54E−17 |
| Freq_comp | 2.36E−16 |
| I_comp_motor | −1.69E−16 |
| Tcond_out | −0.136509384 |
| Twater_delta | 0.000212719 |
| Tcomp_delta | −0.001045883 |
| Tcond_delta | −0.045556499 |

wherein Tcomp_suc is compressor suction temperature, Tcomp_dis compressor is discharge temperature, Tedb is environment temperature, Twater_in is evaporator inlet water temperature, Twater_out is evaporator outlet water temperature, EXV is expansion valve opening degree, Speed_fan is fan rotating speed, Freq_comp is compressor frequency, I_comp_motor is compressor current, Tcond_out is condenser outlet refrigerant temperature, Twater_delta is evaporator inlet and outlet water temperature difference, Tcomp_delta is compressor suction and discharge temperature difference, and Tcond_delta is condenser inlet and outlet refrigerant temperature difference.

For a predicted value $\hat{y}_i$ and a measured value $y_i$ of each input amount, a mean absolute error (MAE) of the input amount is calculated:

$$MAE = \frac{1}{n} \sum_{i=1}^{n} |y_i - \hat{y}_i|.$$

Clearly, there are k MAEs for k inputs, and it is characterized in that the enhanced reconstruction errors are defined as:

$$EnhancedRE = \Sigma_{j=1}^{k} \beta_j MAE_j.$$

Among the parameters calculated in the present application, the reconstruction error enhancement coefficients β represent a contribution degree of each reconstruction error, but $\beta_1, \beta_2, \ldots, \beta_k$ are different from a weighting algorithm, because the general weighting algorithm is used to configure several coefficients with a sum of 1, in order to map a group of vectors with a larger numerical value sum to an average value; and the contribution degree of the $\beta_1, \beta_2, \ldots, \beta_k$ here is based on the sensitivity to perform the method on the deviation that can better reflect the degree of refrigerant leakage, thereby improving the sensitivity, wherein the sum of $\beta_1, \beta_2, \ldots, \beta_k$ may not be equal to 1.

As one embodiment, three sensors are taken as an example, and the reconstruction error enhancement coefficients ($\beta_1$, $\beta_2$, and $\beta_3$) of each sensor are calculated. As shown in Table 4 below, the actual value of the refrigerant charging amounts in the first 1000 seconds(s) is 100 kg, namely, y=100 kg, and each sensor takes 101 (one sample parameter is taken every 10 s) sample parameters (i=101, j=1, 2, 3).

TABLE 4

| Time period data point i | 0 s | 10 s | 20 s | 30 s | 40 s | 50 s | 60 s | . . . | 1000 s |
|---|---|---|---|---|---|---|---|---|---|
| Refrigerant amount at the ith time $y_i$ | 100 kg | 100 kg | 100 kg | 100 kg | 100 kg | 100 kg | 100 kg | . . . | 100 kg |
| Parameters of a first sensor at the ith time $x_i^1$ | $x_1^1$ | $x_2^1$ | $x_3^1$ | $x_4^1$ | $x_5^1$ | $x_6^1$ | $x_7^1$ | . . . | $x_{101}^1$ |
| Parameters of a second sensor at the ith time $x_i^2$ | $x_1^2$ | $x_2^2$ | $x_3^2$ | $x_4^2$ | $x_5^2$ | $x_6^2$ | $x_7^2$ | . . . | $x_{101}^2$ |
| Parameters of a third sensor at the ith time $x_i^3$ | $x_1^3$ | $x_2^3$ | $x_3^3$ | $x_4^3$ | $x_5^3$ | $x_6^3$ | $x_7^3$ | . . . | $x_{101}^3$ |

At this point, for each time sample, the actual value is:

$$\hat{y}_i - \beta_0 + \beta_1 x_i^1 + \beta_2 x_i^2 + \beta_3 x_i^3,$$

the difference between the actual value and the estimated value is:

$$y_i - \hat{y}_i = y_i - (\beta_0 + \beta_1 x_i^1 + \beta_2 x_i^2 + \beta_3 x_i^3),$$

and, for the 101 samples, the formula for the sum of squares of the differences between the measured values and the estimated values is as follows:

$$Q = \Sigma_{i=1}^{101}[y_i - (\beta_0 + \beta_1 x_i^1 + \beta_2 x_i^2 + \beta_3 x_i^3)]^2.$$

The least square method is then used to find a group of coefficients $\beta_1$, $\beta_2$ and $\beta_3$ to minimize Q.

The example embodiment above performs calculation for three sensors, but the calculation method described is applicable to the calculation of the reconstruction error enhancement coefficients of any k sensors.

After the operation of step 413 is completed, the operation goes to step 414. In step 414, the controller 116 performs an operation of input data encoding. The operation of input data encoding will now be described with reference to FIGS. 2A and 2B.

After the optimization process, as shown in FIG. 2B, in step 414, several input subvectors are intercepted from the data test data sequences Cj (j=1, 2, . . . , k) according to the rolling of period time, namely $$(x_1^j, x_2^j, x_3^j, \ldots),$$

each input subvector has n vector elements (or n-dimensional vectors). Each of the n-dimensional input subvectors has i (i=1, 2 . . . , n) vector elements, namely:

$$x_i^j (j = 1, 2, \ldots, k; i = 1, 2, \ldots, n).$$

For example, the data of the past one month (long time series data) is analyzed, and a start point and an end point of the data time correspond to the beginning and end of the month. Based on the above long time series data, several subvectors are intercepted in an indented manner.

After the operation of step 414 is completed, the operation goes to step 415. In step 415, the controller 116 performs an operation of training the LSTM model. The operation of training the LSTM model will now be described in conjunction with FIGS. 2A and 2B.

After the input vector group module 202 (see FIG. 2B) receives the n-dimensional input subvectors $$(x_1^j, x_2^j, x_3^j, \ldots)$$

the output vector group module 210 (see FIG. 2B) generates several output subvectors $$(y_1^j, y_2^j, y_3^j, \ldots), \text{ namely } (\hat{x}_2^j, \hat{x}_3^j, \hat{x}_4^j, \ldots).$$

After the operation of step 415 is completed, the operation goes to step 416. In step 416, the controller 116 obtains test thresholds.

As an illustrative example, this step will now be explained with reference to a system having three sensors (namely, k=3). It will be appreciated that the following description is applicable to systems having any k sensors.

For the first sensor, elements of a first output vector group Y1 are $$[\hat{x}_2^1, \hat{x}_3^1, \ldots, \hat{x}_{n+1}^1],$$

elements of a corresponding first target vector group X2 are $$[x_2^1, x_3^1, \ldots, x_{n+1}^1]$$

and the reconstruction errors for the first output vector group are:

$$RE_1^2 = \frac{1}{n}\sum_{i=1}^{n}\left|x_{i+1}^1 - \hat{x}_{i+1}^1\right|.$$

For the second sensor, elements of a first output vector group Y2 are $$[\hat{x}_2^2, \hat{x}_3^2, \ldots, \hat{x}_{n+1}^2]$$

elements of a corresponding first target vector group X2 are $$[x_2^2, x_3^2, \ldots, x_{n+1}^2]$$

and the reconstruction errors for the first output vector group are:

$$RE_2^2 = \frac{1}{n}\sum_{i=1}^{n}\left|x_{i+1}^2 - \hat{x}_{i+1}^2\right|.$$

For the third sensor, elements of a first output vector group Y3 are $$[\hat{x}_2^3, \hat{x}_3^3, \ldots, \hat{x}_{n+1}^3]$$

elements of a corresponding first target vector group X3 are $$[x_2^3, x_3^3, \ldots, x_{n+1}^3]$$

and the reconstruction errors for the first output vector group are:

$$RE_3^2 = \frac{1}{n}\sum_{i=1}^{n}\left|x_{i+1}^3 - \hat{x}_{i+1}^3\right|.$$

Accordingly, continuing with the example of three input sensors, there are three reconstruction error enhancement coefficients $\beta_1$, $\beta_2$ and $\beta_3$, so the enhanced reconstruction errors of the first output vector group are calculated as follows:

$$EnhancedRE^2 = \beta_1 RE_1^2 + \beta_2 RE_2^2 + \beta_3 RE_3^2,$$

wherein "2" on the left side of the equal sign indicates that the start point and the end point of time correspond to the second input vector group.

For the output vector groups of the second, third and other subsequent period time, the present application repeats the above calculation process to obtain subsequent EnhancedRE$^3$, EnhancedRE$^4$, . . . , EnhancedRE$^{n+1}$. The several enhanced reconstruction errors EnhancedRE$^3$, EnhancedRE$^4$, . . . , EnhancedRE$^{n+1}$ are sorted from high to low, and the average value of the first o enhanced reconstruction errors (e.g., 10 as one example embodiment) are used as the test thresholds. The specific formula for obtaining diagnostic threshold coefficients is as follows.

$$g0 = \frac{1}{o}\sum_{i=1}^{o} EnhancedRE_i,$$

wherein i represents the serial number of the first o enhanced reconstruction errors after sorting, and g0 corresponds to the test data under the no refrigerant leakage condition. Next, the test data under a first leakage amount, a second leakage amount, and a third leakage amount are screened out from the test data set, and step 418 is repeated in the same way to obtain a first test threshold g1, a second test threshold g2 and a third test threshold g3.

After the operation of step 416 is completed, the operation goes to step 418. In step 418, the controller 116 obtains test threshold proportional coefficients. According to the test threshold g0, g1, g2 and g3 that are obtained in step 416, the test threshold proportional coefficients $\alpha_1$, $\alpha_2$ and $\alpha_3$ are calculated, wherein $\alpha_1$=g1/g0, $\alpha_2$=g2/g0, and $\alpha_3$=g3/g0.

At this point, the processing of the test data set (Test Data) has been completed.

Figure 5:
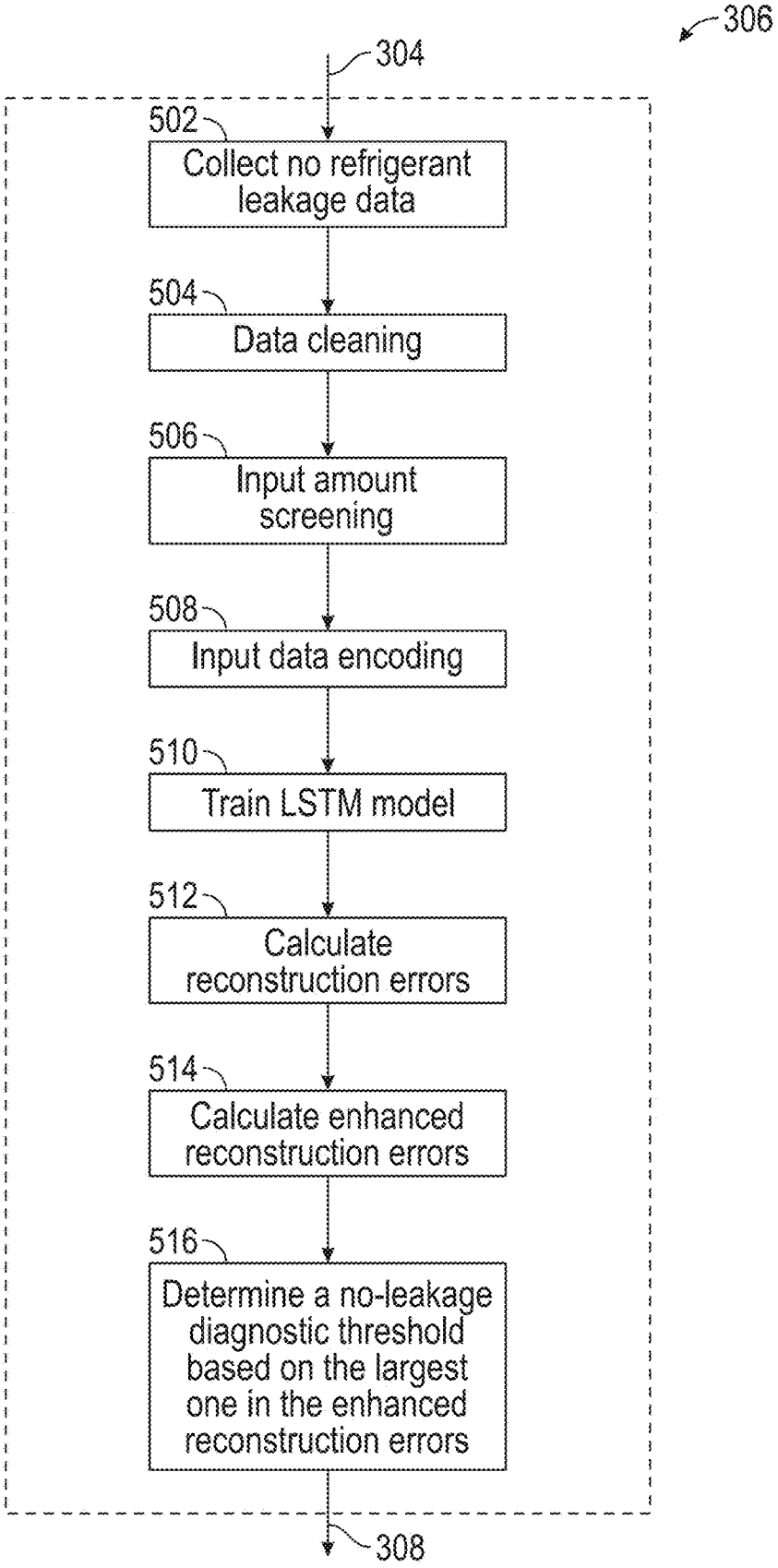
FIG. 5 shows a detailed example of another step in the flow block diagram shown in FIG. 3, according to an exemplary embodiment.

FIG. 5 shows a detailed example of step 306 from the flow block diagram 300 shown in FIG. 3, according to an example embodiment. As shown in FIG. 5, in step 502, under the working condition that the heat transfer system has no refrigerant leakage, the controller 116 performs an operation of data collection. The controller 116 performs the operation of data collection, at step 502, in a similar manner to that described above, with respect to step 402.

After the operation of step 502 is completed, the operation goes to step 504. In step 504, the controller 116 performs an operation of data cleaning. The controller 116 performs the operation of data cleaning, at step 504, in a similar manner to that described above, with respect to step 406.

After the operation of step 504 is completed, the operation goes to step 506. In step 506, the controller 116 performs an operation of data input amount screening. The controller 116 performs the operation of data input screening, at step 506, in a similar manner to that described above, with respect to step 412.

It should be noted that, while the operation steps 504-506 optimize the test data sequences Cj (j=1, 2, . . . , k) collected by the sensors j (j=1, 2, . . . , k) in step 502 (and in accordance with FIG. 2B), even if steps 504-506 are not executed (e.g., step 502 is directly transferred to step 508), this operation method (e.g., the method of performing the no refrigerant leakage data collection and training 306) still provides improved results, which are also within the scope of the present disclosure.

After the operation of step 506 is completed, the operation goes to step 508. In step 508, the controller 116 performs an operation of input data encoding. The controller 116 performs the operation of input data encoding, at step 508, in a similar manner to that described above, with respect to step 414.

After the operation of step 508 is completed, the operation goes to step 510. In step 510, the controller 116 performs an operation of training the LSTM model. The controller 116 performs the operation of training the LSTM model, at step 510, in a similar manner to that described above, with respect to step 415.

After the operation of step 510 is completed, the operation goes to step 512. In step 512, the controller 116 performs an operation of calculating reconstruction errors.

Similar to the method described above, with respect to step 416, three sensors are again used below as an example.

For the first sensor, elements of the first output vector group Y1 are $$[\hat{x}_2^1, \hat{x}_3^1, \ldots, \hat{x}_{n+1}^1],$$

elements of the corresponding first target vector group X2 are $$[x_2^1, x_3^1, \ldots, x_{n+1}^1],$$

and the reconstruction errors for the first output vector group are:

$$RE_1^2 = \frac{1}{n}\sum_{i=1}^{n}\left|x_{i+1}^1 - \hat{x}_{i+1}^1\right|.$$

For the second sensor, elements of the first output vector group Y2 are $$[\hat{x}_2^2, \hat{x}_3^2, \ldots, \hat{x}_{n+1}^2]$$

elements of a corresponding first target vector group X2 are $$[x_2^2, x_3^2, \ldots, x_{n+1}^2],$$

and the reconstruction errors for the first output vector group are:

$$RE_2^2 = \frac{1}{n}\sum_{i=1}^{n}\left|x_{i+1}^2 - \hat{x}_{i+1}^2\right|.$$

For the third sensor, elements of the first output vector group Y3 are $$[\hat{x}_2^3, \hat{x}_3^3, \ldots, \hat{x}_{n+1}^3],$$

elements of a corresponding first target vector group X3 are $$[x_2^3, x_3^3, \ldots, x_{n+1}^3],$$

and the reconstruction errors for the first output vector group are:

$$RE_3^2 = \frac{1}{n}\sum_{i=1}^{n}\left|x_{i+1}^3 - \hat{x}_{i+1}^3\right|.$$

After the operation of step 512 is completed, the operation goes to step 514. In step 514, the controller 116 performs an operation of calculating enhanced reconstruction errors. Continuing with the example of three input sensors, there are three reconstruction error enhancement coefficients $\beta_1$, $\beta_2$ and $\beta_3$, so the enhanced reconstruction errors of the first output vector group are calculated as follows:

$$EnhancedRE^2 = \beta_1 RE_1^2 + \beta_2 RE_2^2 + \beta_3 RE_3^2.$$

For the output vector groups of the second, third and other subsequent periods of time, the present application repeats the above calculation process to obtain enhanced reconstruction errors $EnhancedRE^3$, $EnhancedRE^4$, . . . , $EnhancedRE^{n+1}$ of the subsequent output vector groups.

After the operation of step 514 is completed, the operation goes to step 516. In step 516, the controller 116 selects the largest enhanced reconstruction error from the enhanced reconstruction errors of several output vector groups obtained in the above-mentioned operations as the no leakage diagnostic threshold value: $G0=\max(EnhancedRE_i)$, wherein i=2, 3, 4, . . . .

At this point, the operation of no-refrigerant data collection and training has been completed.

After the operation of step 516 is completed, the operation goes to step 308 (see FIG. 3).

Figure 6:
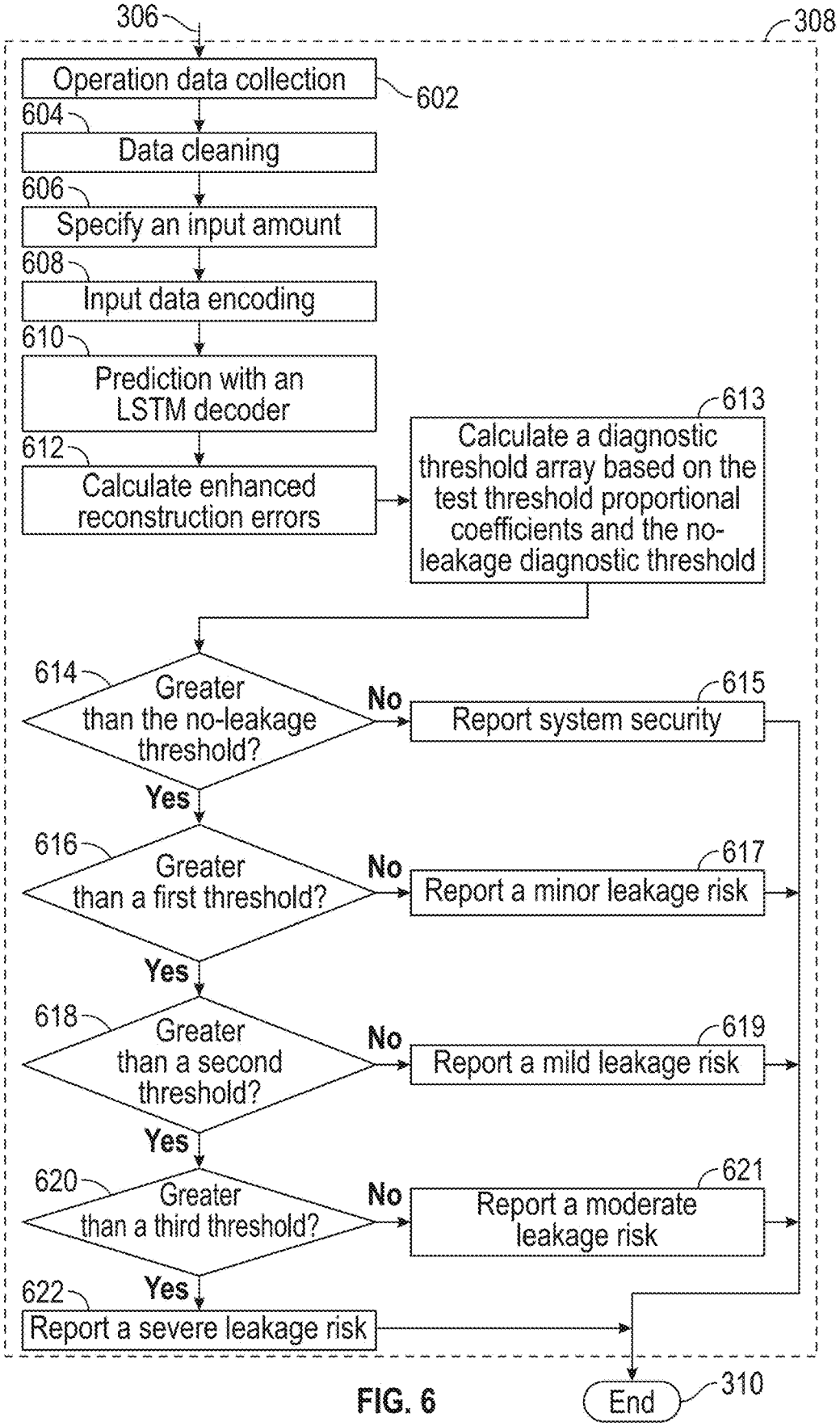
FIG. 6 shows a detailed example of another step in the flow block diagram shown in FIG. 3, according to an exemplary embodiment.

FIG. 6 shows a detailed example of step 308 in the flow block diagram 300 shown in FIG. 3, according to an example embodiment. As shown in FIG. 6, in step 602, in the case of refrigerant leakage diagnosis, the controller 116 performs an operation data collection. In some instances, the operation data collection may be performed over a network (e.g., online data collection). For example, in some embodiments, the controller 116 performs data collection (or online data acquisition), at step 602, in a similar manner to that described above, with respect to step 404.

After the operation of step 602 is completed, the operation goes to step 604. In step 604, the controller 116 performs an operation of data cleaning. In some embodiments, the controller 116 performs the operation of data cleaning, at step 604, in a similar manner to that described above, with respect to step 406.

After the operation of step 604 is completed, the operation goes to step 606. In step 606, the controller 116 performs an operation of specifying an input amount of data. The operation of specifying the input amount is a process of screening the sensors. That is, k pieces of sensor data are selected from all pieces of sensor data as time series data to be analyzed.

It should be noted that, while the operation steps 604-606 optimize the test data sequences Cj (j=1, 2, . . . , k) collected by the sensors j (j=1, 2, . . . , k) in step 602 (and in accordance with FIG. 2B), even if steps 604-606 are not executed (e.g., step 602 is directly transferred to step 608), this method of operation (e.g., the method of performing the refrigerant leakage diagnosis 308) still provides improved results, which are also within the scope of the present disclosure.

After the operation of step 606 is completed, the operation goes to step 608. In step 608, the controller 116 performs an operation of input data encoding, namely, subvector interception. In some embodiments, the controller 116 performs the operation of input data encoding, at step 608, in a manner similar to that described above, with respect to step 414.

After the operation of step 608 is completed, the operation goes to step 610. In step 610, the controller 116 performs an operation of prediction using an LSTM decoder. In some embodiments, the operation of prediction points to the process of inputting the implicit vector in the LSTM decoder and generating the output vector group.

After the operation of step 610 is completed, the operation goes to step 612. In step 612, the controller 116 performs an operation of calculating enhanced reconstruction errors. When executing step 612, the controller 116 obtains the enhanced reconstruction errors according to the reconstruction error enhancement coefficients and the reconstruction errors, and the formula for obtaining the enhanced reconstruction errors is as follows:

$$EnhancedRE_i = \Sigma_{j=1}^{k} \beta_j RE_{i+1}^{j},$$

wherein i=1, 2, 3, . . . .

After the operation of step 612 is completed, the operation goes to step 613. In step 613, a first diagnostic threshold G1, a second diagnostic threshold G2 and a third diagnostic threshold G3 are calculated according to the test threshold proportional coefficients $\alpha 1$, $\alpha 2$ and $\alpha 3$ calculated in step 418 and the no leakage diagnostic threshold G0 calculated in step 516, and the specific calculation formula is as follows: $G1=G0\times\alpha_1$, $G1=G0\times\alpha_2$, and $G1=G0\times\alpha_3$.

After the operation of step 613 is completed, the operation goes to step 614. In step 614, the controller 116 reads 4 levels of diagnostic thresholds G0, G1, G2 and G3, and, if the enhance reconstruction errors are below the no-leakage threshold (e.g., the G0 threshold), the operation flow goes to step 615 after the operation of reading is completed.

The diagnostic thresholds are a group of values. Wherein a first value is a maximum enhanced reconstruction error in the no refrigerant leakage data, and each subsequent value is sequentially greater than the previous value. A preferred embodiment is that the diagnostic thresholds comprise four diagnostic thresholds G0, G1, G2 and G3, wherein G0 is the diagnostic threshold in the no leakage data, $G1=\alpha 1\times G0$, $G2=\alpha 2\times G0$, $G3=\alpha 3\times G0$. In one example embodiment, the results are as follows: G0=0.234, $\alpha_1=1.5$, $\alpha_2=3$, $\alpha_3=6$, $G1=1.5\times 0.2334\approx 0.35$, $G2=3\times 0.2334\approx 0.7$, $G3=6\times 0.2334\approx 1.4$.

In step 614, the controller 116 compares the enhanced reconstruction errors with the no-leakage threshold (i.e., G0). If the enhanced reconstruction errors are not greater than the no-leakage threshold, then it goes to step 615 to report system security (e.g., that the system is functioning properly) to one or more entities associated with the heat transfer system 100 via an input/output device or another user device (e.g., user device 1076 described below), and then goes to step 310 (see FIG. 3) to stop the diagnostic operational flow.

If the reconstruction errors are greater than the no-leakage threshold, the controller 116 proceeds to step 616. In step 616, the controller 116 compares the enhanced reconstruction errors with the first threshold (i.e., G1). If the enhanced reconstruction errors are not greater than the first threshold, then the controller 116 proceeds to step 617 to report a minor leakage risk to one or more entities associated with the heat transfer system 100 via an input/output device or another user device (e.g., user device 1076 described below), and then goes to step 310 (see FIG. 3) to stop the diagnostic operation flow.

If the reconstruction errors are greater than the first threshold, the controller proceeds to step 618. In step 618, the controller 116 compares the enhanced reconstruction errors to the second threshold (i.e., G2). If the enhanced reconstruction errors are not greater than the second threshold, then it goes to step 619 to report a mild leakage risk (e.g., higher than the minor leakage risk discussed above) to one or more entities associated with the heat transfer system 100 via an input/output device or another user device (e.g., user device 1076 described below), and then goes to step 310 (see FIG. 3) to stop the diagnostic operation flow.

If the reconstruction errors are greater than the second threshold, the controller 116 proceeds to step 620. In step 620, the controller 116 compares the enhanced reconstruction errors with the third threshold (i.e., G3). If the enhanced reconstruction errors are not greater than the third threshold, then it goes to step 621 to report a moderate leakage risk (e.g., higher than the mild leakage risk discussed above) to one or more entities associated with the heat transfer system 100 via an input/output device or another user device (e.g., user device 1076 described below), and then goes to step 310 (see FIG. 3) to stop the diagnostic operation flow. If the enhanced reconstruction errors are greater than the third threshold, it goes to step 622 to report a severe leakage risk (e.g., higher than the moderate leakage risk discussed above) to one or more entities associated with the heat transfer system 100 via an input/output device or another user device (e.g., user device 1076 described below), and then it goes to step 310 (see FIG. 3) to stop the diagnostic operation flow.

It should be appreciated that, while an LSTM model is described herein, in some instances, various other types of machine learning models (e.g., other types of recurrent neural network models) may be utilized to similarly predict subsequent data vectors to allow for similar reconstruction errors, reconstruction error enhancement coefficients, and enhanced reconstruction errors to be generated in a similar manner to that described above using the LSTM model.

Figure 7:
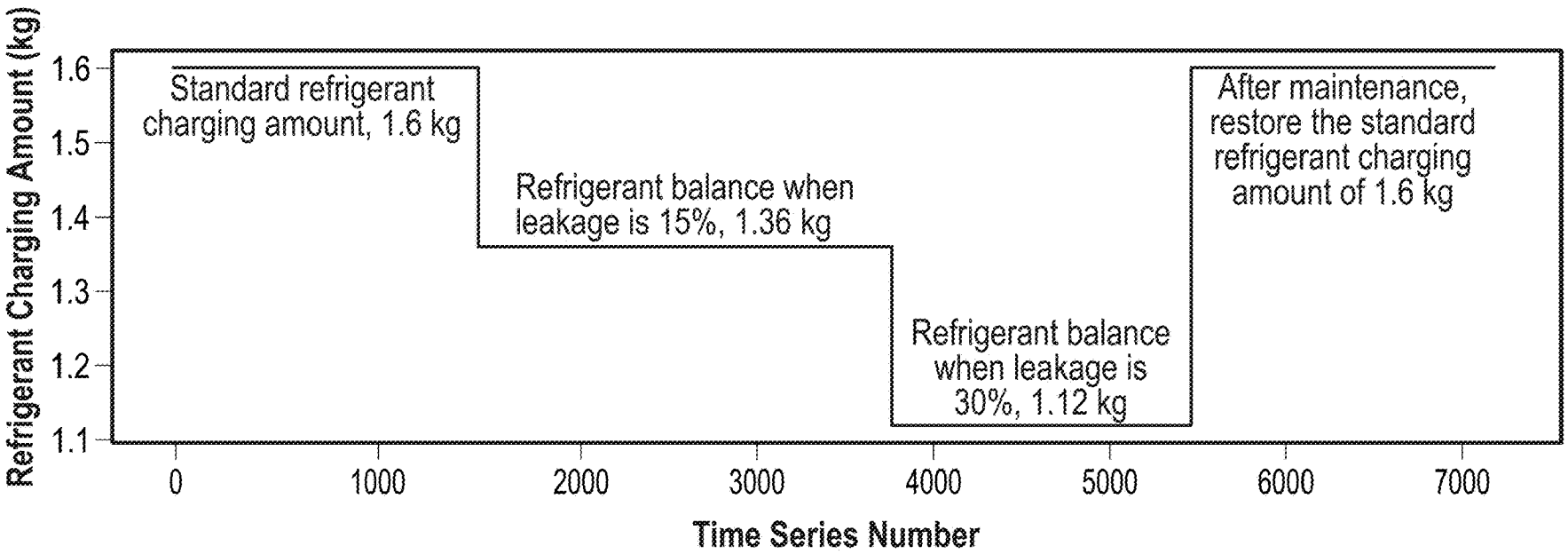
FIG. 7 shows a chart illustrating test steps under different refrigerant charging amounts, according to an exemplary embodiment.
Figure 8:
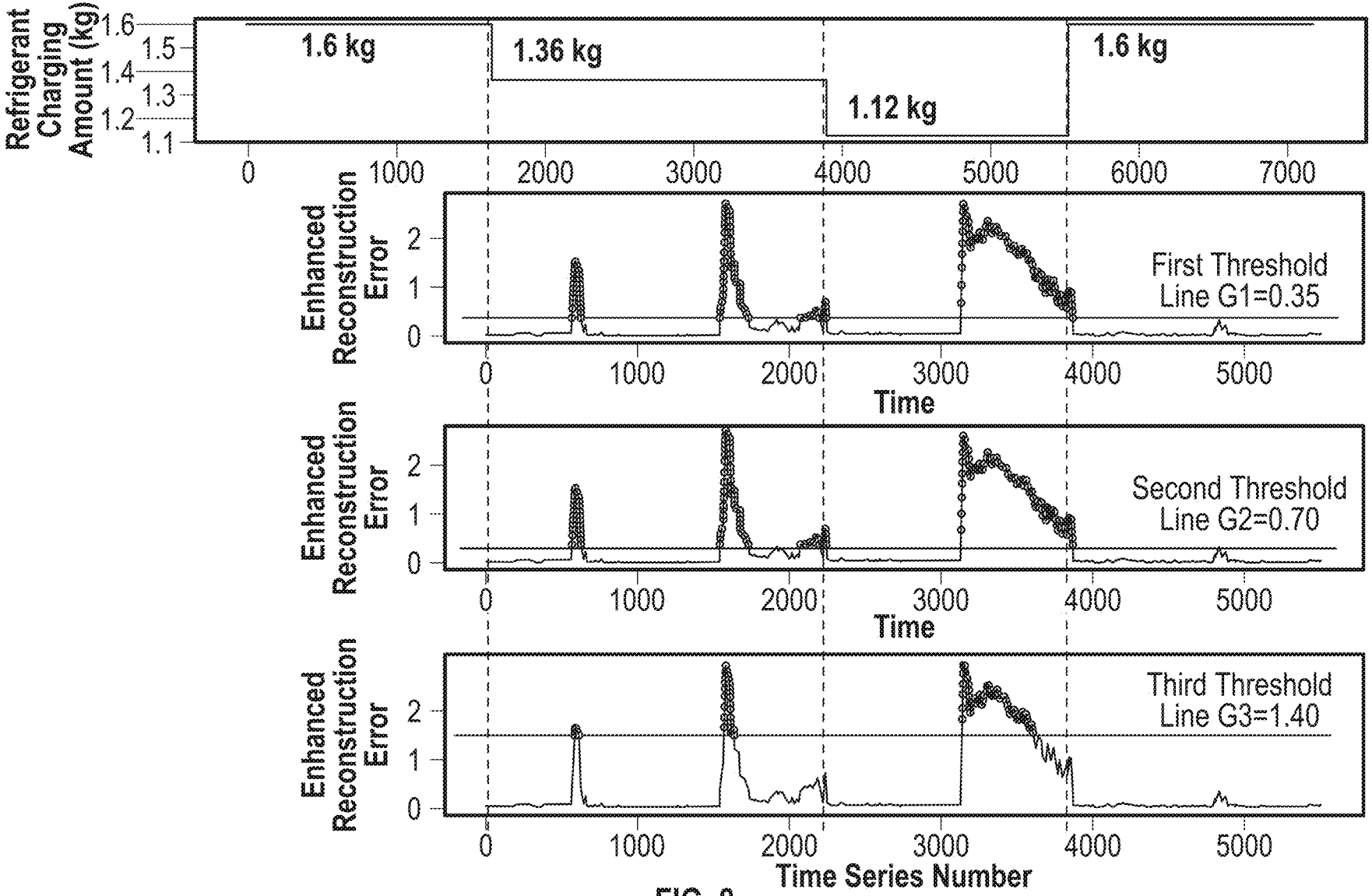
FIG. 8 shows an implementation effect of a diagnosis process shown in FIG. 7, according to an exemplary embodiment.

FIGS. 7 and 8 show an implementation process of verifying the validity of the model with a piece of test data, according to an example embodiment.

FIG. 7 shows the test steps under different refrigerant charging amounts. For example, step 1 (e.g., between 0 and approximately 1600 on the time series) is a time period within which the controller 116 was performing several condition combination tests under the standard refrigerant charging amount of 1.6 kg; step 2 (e.g., between approximately 1600 on the time series and approximately 3900 on the time series) is a time period within which the controller 116 discharged part of the refrigerant to adjust the charging amount to 1.36, simulating a 15% leakage state, and was performing several condition combination tests under the simulated 15% leakage state; and step 3 (e.g., between approximately 3900 on the time series and approximately 5500 on the time series) is a time period within which the controller 116 discharged another part of the refrigerant to adjust the charging amount to 1.12, simulating a 30% leakage state, and was performing several condition combination tests under the simulated 30% leakage state.

Accordingly, the first 1661 pieces of data (e.g., step 1) are the data under the standard refrigerant charging amount, and model parameters of an LSTM encoding network and a decoding network can be trained through these data. After the training, the no-leakage threshold G0 can be obtained by calculation, and the first diagnostic threshold G1, the second diagnostic threshold G2, and the third diagnostic threshold G3 are obtained through calculation by a threshold proportional coefficient, in a similar manner to that described above, with respect to method 300.

In FIG. 7, the abscissa (i.e., the x-axis) is the time serial number, that is, changes in refrigerant charging amounts in the whole test process are recorded, and the ordinate (i.e., the y-axis) is the refrigerant charging amounts. As mentioned above, in some embodiments, the first 1661 pieces of data are used as no leakage data, which are used to train the model parameters of the LSTM encoding network and the decoding network, and to calculate a threshold array of refrigerant leakage. The following 5400 pieces of data are used as online monitoring verification data. Different thresholds are used to obtain the results of calculating the reduction enhancement deviations, and refrigerant leakage diagnosis is performed in accordance with the methods described herein (e.g., method 300).

FIG. 8 shows an implementation effect of the diagnosis process shown in FIG. 7, according to an example embodiment. The data with the charging amounts of 1.36 kg, 1.12 kg and 1.6 kg is processed with the trained model. Here, the first threshold, the second threshold, and the third threshold correspond to the enhanced reconstruction errors under the 5% leakage amount, the 10% leakage amount, and the 15% leakage amount, respectively, and the parts exceeding the thresholds are marked in with circular data points on the display screen (as illustrated in FIG. 8). Accordingly, the systems and methods described herein allow for the identification of whether and to what corresponding degree refrigerant leakage occurs within a piece of time series data.

Figure 9:
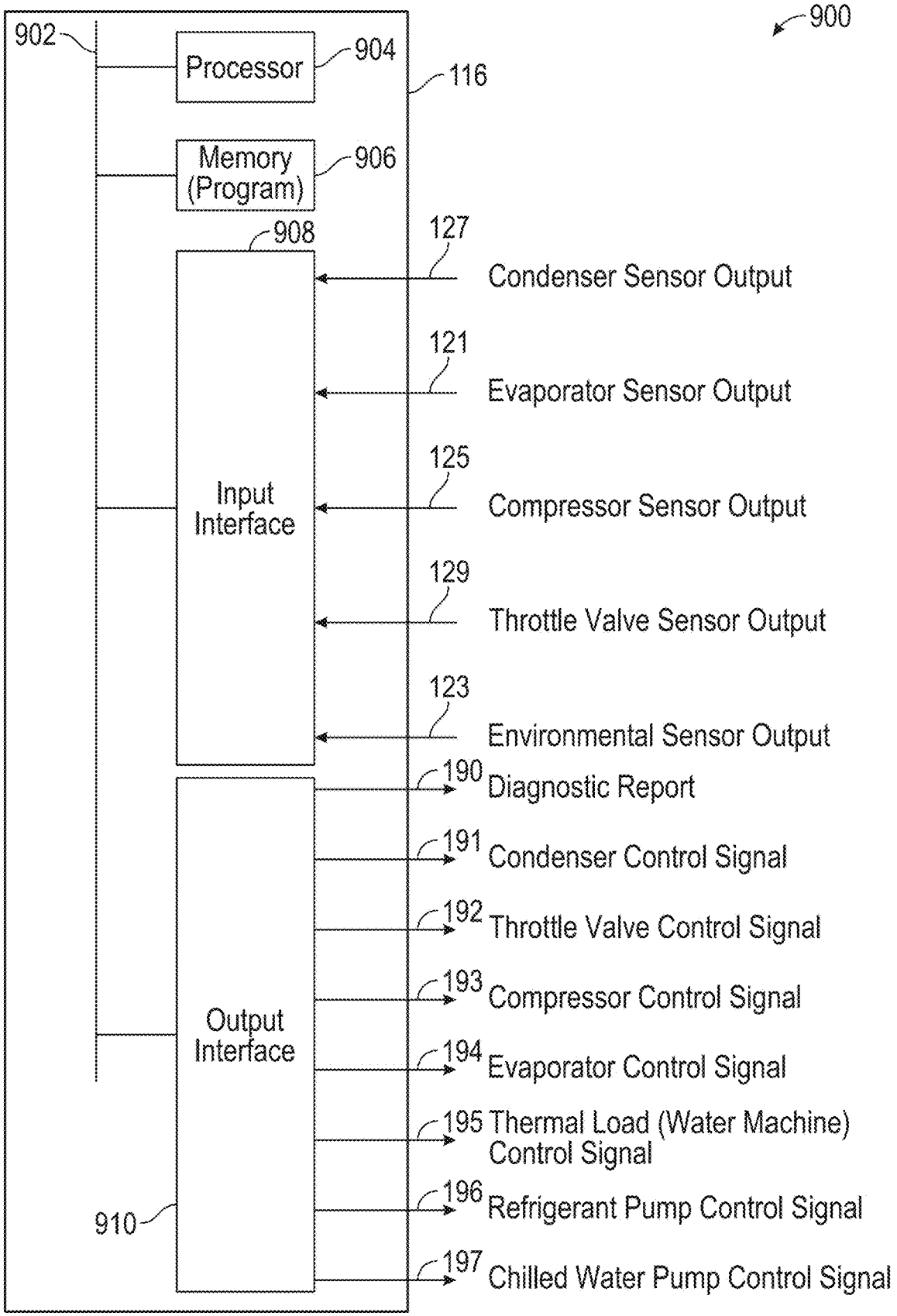
FIG. 9 shows a block diagram of a detailed example of a controller of the system of FIG. 1A, according to an exemplary embodiment.

FIG. 9 shows a block diagram of specific details of the controller 116 shown in FIG. 1A, showing the main components of the controller 116. The controller 116 can store and execute programs shown in the flows shown in FIGS. 3-6, and store and call parameters required by the flows shown in FIGS. 3-6.

As shown in FIG. 9, the controller 116 includes a bus 902, a processor 904, a memory 906, an input interface 908, and an output interface 910. The processor 904, the memory 906, the input interface 908, and the output interface 910 are connected to the bus 902. The processor 904 can read a program (or instruction) stored on the memory 906 and execute the program (or instruction) to process data. The processor 904 can also write the data or the program (or instruction) and store the data or the program within the memory 906. The memory 906 can store the program (instruction) or the data. By executing the instruction in the memory 906, the processor 904 can control the memory 906, the input interface 908, and the output interface 910. In some embodiments, the memory 906 stores one or more programs for executing the flows shown in FIGS. 3-6 and operation parameters required for executing the one or more programs.

The input interface 908 is configured to receive sensor parameters from the condenser sensor 107, the evaporator sensor 111, the compressor sensor 105, the throttle valve sensor 109, and the environmental sensor 113 through connection lines 127, 121, 125, 129, 123, respectively, convert the data of these parameters into signals that can be identified by the processor 904 and store them in the memory 906.

The processor 904 is configured to calculate related parameters of the diagnostic report according to the program stored in the memory 906.

The output interface 910 is configured to receive the related parameters of the diagnostic report from the processor 904, convert the related parameters into a readable diagnostic report, and output the generated diagnostic report from the output interface 910 through the connection line 190 to one or more entities associated with the heat transfer system 100 via an input/output device or another user device (e.g., user device 1076 described below). The output interface 910 is further configured to receive condenser control parameters, throttle valve control parameters, compressor control parameters, evaporator control parameters, thermal load (water machine) control parameters, refrigerant pump control parameters and chilled water pump control parameters from the processor 904, and output and generate condenser control signals, throttle valve control signals, compressor control signals, evaporator control signals, thermal load (water machine) control signals, refrigerant pump control signals and chilled water pump control signals through the connection lines 191, 192, 193, 194, 195, 196, 197 from the output interface 910. In some embodiments, the various connection lines 190-197 can be any suitable type of wired or wireless connection, as desired for a given application. For example, in some instances, the processor 904 is configured to activate, deactivate, or modify operation of any of the various components (e.g., the compressor 104, the condenser 106, the condenser fan 117, the throttle valve 108, the refrigerant pump 186, and/or the evaporator 110) to reduce or stop a detected refrigerant leakage. In some instances, the processor 904 is further configured to raise an alarm (e.g., an audible alarm or a visual alarm within a building) indicating the refrigerant leakage.

Since it is difficult to design a completely sealed heat transfer system (e.g., a completely sealed air-conditioning system), refrigerant leakage is the most common heat transfer system failure. When refrigerant leakage occurs in the heat transfer system, it usually manifests as a deterioration in refrigeration or heating capacity (corresponding to heat pumps) and an increase in power consumption. After refrigerant leakage occurs, in order to maintain the set temperature of a room and maintain the refrigeration capacity, the heat transfer system has to run at a higher current, thereby increasing the probability of failure.

Compared with prior heat transfer control systems based on data-driven or machine learning diagnostic methods, the heat transfer control system and control methods described herein provide, among other things, the following technical benefits.

First, the methods described herein utilize a weakly supervised learning method. That is, a small number of refrigerant leakage tests (e.g., less tests than generally required by prior diagnostic methods) are used to obtain the threshold ratio and the reconstruction error enhancement coefficients described herein. For example, in one product series, only a small number of tests need to be done on one type of heat transfer system (e.g., one type of HVAC system, one type of chiller, one type of air-conditioning unit), and the rest of the training and diagnosis process is completely completed on a customer unit.

Second, the diagnostic results of the methods described herein provide high sensitivity and stability. The heightened sensitivity is provided, in part, by effectively identifying and separating out parameters that are particularly relevant to detecting refrigerant leakage. In some embodiments, the heightened sensitivity allows for refrigerant leakage within 5% of a full refrigerant charge can be identified. Generally, when a heat transfer system (e.g., an air-conditioning unit or system) leaks within 5% of the total refrigerant, the state parameters of the system change very little. In the present application, the sensitivity can be improved through the reconstruction error enhancement coefficients. The stability means that the present application can make a reliable diagnosis under complex variable conditions, which may be provided, in part, by the normalization of the predicted data, as discussed above.

Third, the systems and methods described herein allow for real-time diagnosis of status data just collected and the provision of real-time or near real-time diagnostic results, so that customers and/or maintenance personnel are able to quickly identify refrigerant leakages and make repairs, thereby reducing the customer's operating cost, downtime, and shutdown losses caused by unexpected failures of the heat transfer systems (e.g., HVAC systems, chillers, air-conditioning units).

Fourth, the systems and methods described herein are applicable to all heat transfer systems (e.g., HVAC systems, chillers, air-conditioning units) that use refrigerant vapor compression circulation for refrigeration or heating.

Fifth, the systems and methods described herein can perform hierarchical management of the diagnostic thresholds, and realize leakage risk classification, including (i) security (e.g., the system is running correctly/is not experiencing a leak), (ii) reporting the minor leakage risk, (iii) reporting the mild leakage risk, (iv) reporting the moderate leakage risk, and (v) reporting the severe leakage risk.

Sixth, by means of the control method described herein, sensitive features can be found from a large number of system sensor parameters, and the refrigerant leakage factors can be separated from other failure factors, so as to increase the processing speed of the diagnosis method and reduce the processing burden of the system.

It should be appreciated that, while various examples are provided herein, the same and/or similar methods described herein are similarly applicable for detecting refrigerant leakages within a variety of systems, devices, and/or other components that utilize circulating refrigerant to provide heating or cooling. For example, the same and/or similar methods may be utilized to detect refrigerant leakages within HVAC systems, within chillers or chiller units, within other air-conditioning systems generally, etc.

Figure 10:
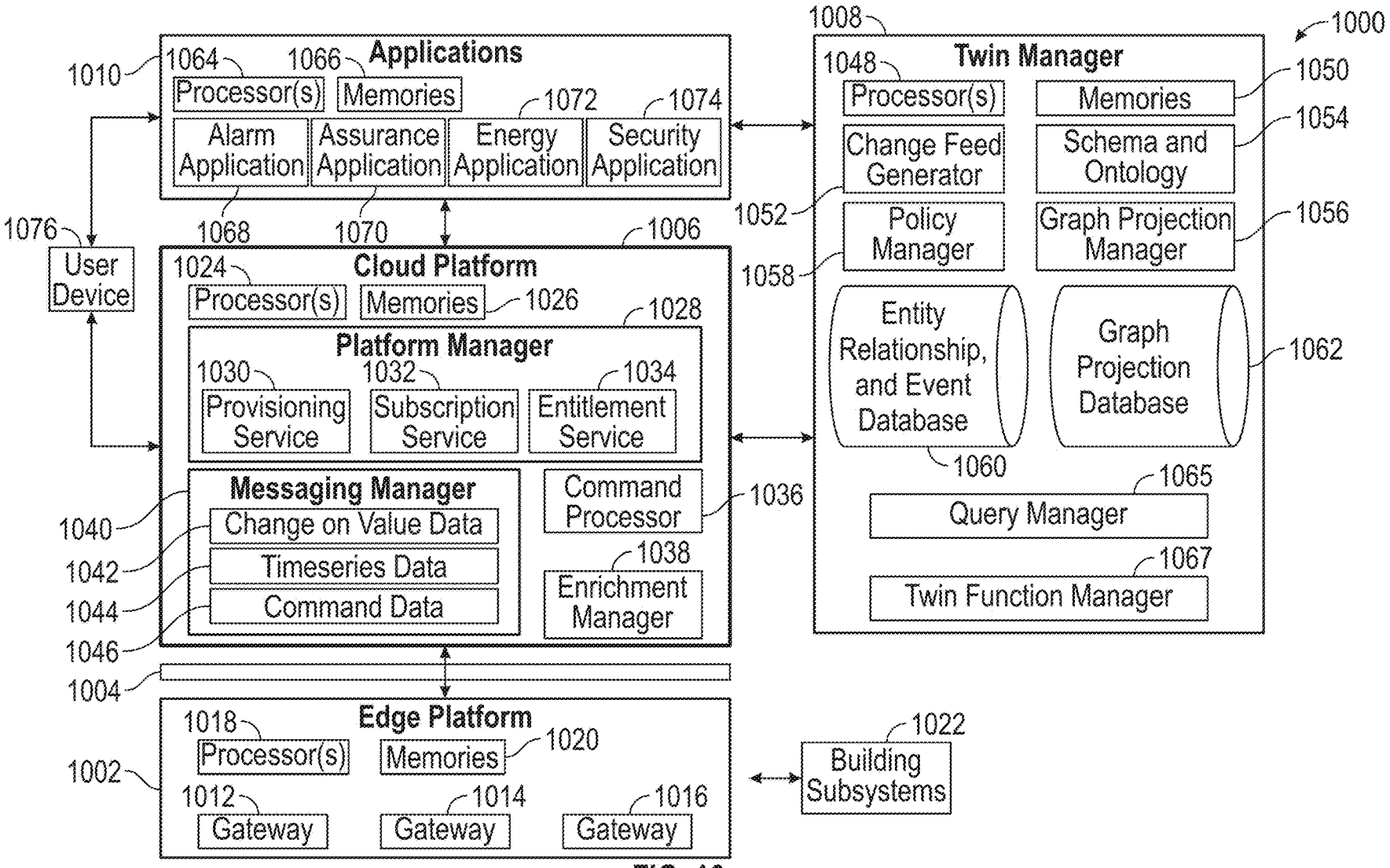
FIG. 10 is a block diagram of a building data platform including an edge platform, a cloud platform, and a twin manager, according to an exemplary embodiment.

Referring now to FIG. 10, a building data platform 1000 that may employ the heat transfer system refrigerant leakage detection described above is shown, according to an example embodiment. The building data platform 1000 includes an edge platform 1002, a cloud platform 1006, and a twin manager 1008. The edge platform 1002, the cloud platform 1006, and the twin manager 1008 can each be separate services deployed on the same or different computing systems. In some embodiments, the cloud platform 1006 and the twin manager 1008 are implemented in off premises computing systems, e.g., outside a building. The edge platform 1002 can be implemented on-premises, e.g., within the building. However, any combination of on-premises and off-premises components of the building data platform 1000 can be implemented.

The building data platform 1000 includes applications 1010. The applications 1010 can be various applications that operate to manage the building subsystems 1022. The applications 1010 can be remote or on-premises applications (or a hybrid of both) that run on various computing systems. The applications 1010 can include an alarm application 1068 configured to manage alarms for the building subsystems 1022. The applications 1010 include an assurance application 1070 that implements assurance services for the building subsystems 1022. In some embodiments, the applications 1010 include an energy application 1072 configured to manage the energy usage of the building subsystems 1022. The applications 1010 include a security application 1074 configured to manage security systems of the building.

In some embodiments, the applications 1010 and/or the cloud platform 1006 interacts with a user device 1076. In some embodiments, a component or an entire application of the applications 1010 runs on the user device 1076. The user device 1076 may be a laptop computer, a desktop computer, a smartphone, a tablet, and/or any other device with an input interface (e.g., touch screen, mouse, keyboard, etc.) and an output interface (e.g., a speaker, a display, etc.).

The applications 1010, the twin manager 1008, the cloud platform 1006, and the edge platform 1002 can be implemented on one or more computing systems, e.g., on processors and/or memory devices. For example, the edge platform 1002 includes processor(s) 1018 and memories 1020, the cloud platform 1006 includes processor(s) 1024 and memories 1026, the applications 1010 include processor(s) 1064 and memories 1066, and the twin manager 1008 includes processor(s) 1048 and memories 1050. In some embodiments, one or more of the processors 1018, 1048, 1064 and/or memories 1026, 1050, 1066 may implement some or all of the functionality of the controller 520 discussed above to allow for the detection of refrigerant leakage associated with a heat transfer system, such as an HVAC or air-conditioning system (e.g., one of the building subsystems 122), within the building associated with the building data platform 1000, in accordance with the methods described herein.

The processors can be general purpose or specific purpose processors, an application specific integrated circuit (ASIC), one or more field programmable gate arrays (FPGAs), a group of processing components, or other suitable processing components. The processors may be configured to execute computer code and/or instructions stored in the memories or received from other computer readable media (e.g., CDROM, network storage, a remote server, etc.).

The memories can include one or more devices (e.g., memory units, memory devices, storage devices, etc.) for storing data and/or computer code for completing and/or facilitating the various processes described in the present disclosure. The memories can include random access memory (RAM), read-only memory (ROM), hard drive storage, temporary storage, non-volatile memory, flash memory, optical memory, or any other suitable memory for storing software objects and/or computer instructions. The memories can include database components, object code components, script components, or any other type of information structure for supporting the various activities and information structures described in the present disclosure. The memories can be communicably connected to the processors and can include computer code for executing (e.g., by the processors) one or more processes described herein.

The edge platform 1002 can be configured to provide connection to the building subsystems 1022. The building subsystems 1022 can include a variety of systems associated with and/or provided within the building associated with the building data platform 1000. For example, in some instances, the building subsystems 1022 may include a fire prevention subsystem, an HVAC subsystem (e.g., the heat transfer system 100), a security subsystem, etc. The edge platform 1002 can receive messages from the building subsystems 1022 and/or deliver messages to the building subsystems 1022. The edge platform 1002 includes one or multiple gateways, e.g., the gateways 1012-1016. The gateways 1012-1016 can act as a gateway between the cloud platform 1006 and the building subsystems 1022. The gateways 1012-1016 can be or function similar to the gateways described in U.S. patent application Ser. No. 17/127,303, filed Dec. 18, 2020, the entirety of which is incorporated by reference herein. In some embodiments, the applications 1010 can be deployed on the edge platform 1002. In this regard, lower latency in management of the building subsystems 1022 can be realized.

The edge platform 1002 can be connected to the cloud platform 1006 via a network 1004. The network 1004 can communicatively couple the devices and systems of building data platform 1000. In some embodiments, the network 1004 is at least one of and/or a combination of a Wi-Fi network, a wired Ethernet network, a ZigBee network, a Bluetooth network, and/or any other wireless network. The network 1004 may be a local area network or a wide area network (e.g., the Internet, a building WAN, etc.) and may use a variety of communications protocols (e.g., BACnet, IP, LON, etc.). The network 1004 may include routers, modems, servers, cell towers, satellites, and/or network switches. The network 1004 may be a combination of wired and wireless networks.

The cloud platform 1006 can be configured to facilitate communication and routing of messages between the applications 1010, the twin manager 1008, the edge platform 1002, and/or any other system. The cloud platform 1006 can include a platform manager 1028, a messaging manager 1040, a command processor 1036, and an enrichment manager 1038. In some embodiments, the cloud platform 1006 can facilitate messaging between the building data platform 1000 via the network 1004.

The messaging manager 1040 can be configured to operate as a transport service that controls communication with the building subsystems 1022 and/or any other system, e.g., managing commands to devices (C2D), commands to connectors (C2C) for external systems, commands from the device to the cloud (D2C), and/or notifications. The messaging manager 1040 can receive different types of data from the applications 1010, the twin manager 1008, and/or the edge platform 1002. The messaging manager 1040 can receive change on value data 1042, e.g., data that indicates that a value of a point has changed. The messaging manager 1040 can receive time series data 1044, e.g., a time correlated series of data entries each associated with a particular time stamp. Furthermore, the messaging manager 1040 can receive command data 1046. All of the messages handled by the cloud platform 1006 can be handled as an event, e.g., the data 1042-1046 can each be packaged as an event with a data value occurring at a particular time (e.g., a temperature measurement made at a particular time).

The cloud platform 1006 includes a command processor 1036. The command processor 1036 can be configured to receive commands to perform an action from the applications 1010, the building subsystems 1022, the user device 1076, etc. The command processor 1036 can manage the commands, determine whether the commanding system is authorized to perform the particular commands, and communicate the commands to the commanded system, e.g., the building subsystems 1022 and/or the applications 1010. The commands could be a command to change an operational setting that control environmental conditions of a building, a command to run analytics, etc.

The cloud platform 1006 includes an enrichment manager 1038. The enrichment manager 1038 can be configured to enrich the events received by the messaging manager 1040. The enrichment manager 1038 can be configured to add contextual information to the events. The enrichment manager 1038 can communicate with the twin manager 1008 to retrieve the contextual information. In some embodiments, the contextual information is an indication of information related to the event. For example, if the event is a time series temperature measurement of a thermostat, contextual information such as the location of the thermostat (e.g., what room), the equipment controlled by the thermostat (e.g., what VAV), etc. can be added to the event. In this regard, when a consuming application, e.g., one of the applications 1010 receives the event, the consuming application can operate based on the data of the event, the temperature measurement, and also the contextual information of the event.

The enrichment manager 1038 can solve a problem that when a device produces a significant amount of information, the information may contain simple data without context. An example might include the data generated when a user scans a badge at a badge scanner of the building subsystems 1022. This physical event can generate an output event including such information as "DeviceBadgeScannerID," "BadgeID," and/or "Date/Time." However, if a system sends this data to a consuming application, e.g., Consumer A and a Consumer B, each customer may need to call the building data platform knowledge service to query information with queries such as, "What space, build, floor is that badge scanner in?" or "What user is associated with that badge?"

By performing enrichment on the data feed, a system can be able to perform inferences on the data. A result of the enrichment may be transformation of the message "DeviceBadgeScannerId, BadgeId, Date/Time," to "Region, Building, Floor, Asset, DeviceId, BadgeId, UserName, EmployeeId, Date/Time Scanned." This can be a significant optimization, as a system can reduce the number of calls by 1/n, where n is the number of consumers of this data feed.

By using this enrichment, a system can also have the ability to filter out undesired events. If there are 100 building in a campus that receive 100,000 events per building each hour, but only 1 building is actually commissioned, only 1/10 of the events are enriched. By looking at what events are enriched and what events are not enriched, a system can do traffic shaping of forwarding of these events to reduce the cost of forwarding events that no consuming application wants or reads.

An example of an event received by the enrichment manager 1038 may be:

```
{
"id": "someguid",
"eventType": "Device_Heartbeat",
"eventTime": "2018-01-27T00:00:00+00:00"
"eventValue": 1,
"deviceID": "someguid"
}
```

An example of an enriched event generated by the enrichment manager 1038 may be:

{
"id": "someguid",
"eventType": "Device_Heartbeat",
"eventTime": "2018-01-27T00:00:00+00:00"
"eventValue": 1,
"deviceID": "someguid",
"buildingName": "Building-48",
"buildingID": "SomeGuid",
"panelID": "SomeGuid",
"panelName": "Building-48-Panel-13",
"cityID": 371,
"cityName": "Milwaukee",
"stateID": 48,
"stateName": "Wisconsin (WI)",
"countryID": 1,
"countryName": "United States"
}

By receiving enriched events, an application of the applications 1010 can be able to populate and/or filter what events are associated with what areas. Furthermore, user interface generating applications can generate user interfaces that include the contextual information based on the enriched events.

The cloud platform 1006 includes a platform manager 1028. The platform manager 1028 can be configured to manage the users and/or subscriptions of the cloud platform 1006. For example, what subscribing building, user, and/or tenant utilizes the cloud platform 1006. The platform manager 1028 includes a provisioning service 1030 configured to provision the cloud platform 1006, the edge platform 1002, and the twin manager 1008. The platform manager 1028 includes a subscription service 1032 configured to manage a subscription of the building, user, and/or tenant while the entitlement service 1034 can track entitlements of the buildings, users, and/or tenants.

The twin manager 1008 can be configured to manage and maintain a digital twin. The digital twin can be a digital representation of the physical environment, e.g., a building. The twin manager 1008 can include a change feed generator 1052, a schema and ontology 1054, a graph projection manager 1056, a policy manager 1058, an entity, relationship, and event database 1060, and a graph projection database 1062.

The graph projection manager 1056 can be configured to construct graph projections and store the graph projections in the graph projection database 1062. For example, the graph projections can be similar to or the same as those described in U.S. patent application Ser. No. 17/834,768, filed Jun. 7, 2022, the entirety of which is incorporated by reference herein. Entities, relationships, and events can be stored in the database 1060. The graph projection manager 1056 can retrieve entities, relationships, and/or events from the database 1060 and construct a graph projection based on the retrieved entities, relationships and/or events. In some embodiments, the database 1060 includes an entity-relationship collection for multiple subscriptions.

In some embodiment, the graph projection manager 1056 generates a graph projection for a particular user, application, subscription, and/or system. In this regard, the graph projection can be generated based on policies for the particular user, application, and/or system in addition to an ontology specific for that user, application, and/or system. In this regard, an entity could request a graph projection and the graph projection manager 1056 can be configured to generate the graph projection for the entity based on policies and an ontology specific to the entity. The policies can indicate what entities, relationships, and/or events the entity has access to. The ontology can indicate what types of relationships between entities the requesting entity expects to see, e.g., floors within a building, devices within a floor, etc. Another requesting entity may have an ontology to see devices within a building and applications for the devices within the graph.

The graph projections generated by the graph projection manager 1056 and stored in the graph projection database 1062 can be a knowledge graph and is an integration point. For example, the graph projections can represent floor plans and systems associated with each floor. Furthermore, the graph projections can include events, e.g., telemetry data of the building subsystems 1022. For example, in some instances, the telemetry data can include any of the sensor data described above (e.g., received from any of the sensors 105, 107, 109, 111, 113) or from similar sensors of any other heat transfer system, such as an HVAC or air-conditioning system within the building. The graph projections can show application services as nodes and API calls between the services as edges in the graph. The graph projections can illustrate the capabilities of spaces, users, and/or devices. The graph projections can include indications of the building subsystems 1022, e.g., thermostats, cameras, VAVs, etc. The graph projection database 1062 can store graph projections that keep up a current state of a building.

The graph projections of the graph projection database 1062 can be digital twins of a building. Digital twins can be digital replicas of physical entities (e.g., locations, spaces, equipment, assets, etc.) that enable an in-depth analysis of data of the physical entities and provide the potential to monitor systems to mitigate risks, manage issues, and utilize simulations to test future solutions. For example, in some embodiments, a heat transfer system, such as an HVAC, air-conditioning, or chiller system, can be replicated and monitored within the context of a digital twin to detect refrigerant leaks in accordance with the systems and methods described herein (e.g., with reference to FIGS. 1-9). Digital twins can play an important role in helping technicians find the root cause of issues and solve problems faster, in supporting safety and security protocols, and in supporting building managers in more efficient use of energy and other facilities resources. Digital twins can be used to enable and unify security systems, employee experience, facilities management, sustainability, etc.

In some embodiments the enrichment manager 1038 can use a graph projection of the graph projection database 1062 to enrich events. In some embodiments, the enrichment manager 1038 can identify nodes and relationships that are associated with, and are pertinent to, the device that generated the event. For example, the enrichment manager 1038 could identify a thermostat generating a temperature measurement event within the graph. The enrichment manager 1038 can identify relationships between the thermostat and spaces, e.g., a zone that the thermostat is located in. The enrichment manager 1038 can add an indication of the zone to the event.

Furthermore, the command processor 1036 can be configured to utilize the graph projections to command the building subsystems 1022. For example, in some embodiments, upon detecting a refrigerant leak, as discussed above, the command processor 1036 can command one or more building subsystems 1022 to perform various response actions in response to a detected refrigerant leakage. The command processor 1036 can identify a policy for a commanding entity within the graph projection to determine whether the commanding entity has the ability to make the command. For example, the command processor 1036, before allowing a user to make a command, may determine, based on the graph projection database 1062, that the user has a policy to be able to make the command.

In some embodiments, the policies can be conditional based policies. For example, the building data platform 1000 can apply one or more conditional rules to determine whether a particular system has the ability to perform an action. In some embodiments, the rules analyze a behavioral based biometric. For example, a behavioral based biometric can indicate normal behavior and/or normal behavior rules for a system. In some embodiments, when the building data platform 1000 determines, based on the one or more conditional rules, that an action requested by a system does not match a normal behavior, the building data platform 1000 can deny the system the ability to perform the action and/or request approval from a higher-level system.

For example, a behavior rule could indicate that a user has access to log into a system with a particular IP address between 8 A.M. through 5 P.M. However, if the user logs in to the system at 7 P.M., the building data platform 1000 may contact an administrator to determine whether to give the user permission to log in.

The change feed generator 1052 can be configured to generate a feed of events that indicate changes to the digital twin, e.g., to the graph. The change feed generator 1052 can track changes to the entities, relationships, and/or events of the graph. For example, the change feed generator 1052 can detect an addition, deletion, and/or modification of a node or edge of the graph, e.g., changing the entities, relationships, and/or events within the database 1060. In response to detecting a change to the graph, the change feed generator 1052 can generate an event summarizing the change. The event can indicate what nodes and/or edges have changed and how the nodes and edges have changed. The events can be posted to a topic by the change feed generator 1052.

The change feed generator 1052 can implement a change feed of a knowledge graph. The building data platform 1000 can implement a subscription to changes in the knowledge graph. When the change feed generator 1052 posts events in the change feed, subscribing systems or applications can receive the change feed event. By generating a record of all changes that have happened, a system can stage data in different ways, and then replay the data back in whatever order the system wishes. This can include running the changes sequentially one by one and/or by jumping from one major change to the next. For example, to generate a graph at a particular time, all change feed events up to the particular time can be used to construct the graph.

The change feed can track the changes in each node in the graph and the relationships related to them, in some embodiments. If a user wants to subscribe to these changes and the user has proper access, the user can simply submit a web API call to have sequential notifications of each change that happens in the graph. A user and/or system can replay the changes one by one to reinstitute the graph at any given time slice. Even though the messages are "thin" and only include notification of change and the reference "id/seq id," the change feed can keep a copy of every state of each node and/or relationship so that a user and/or system can retrieve those past states at any time for each node. Furthermore, a consumer of the change feed could also create dynamic "views" allowing different "snapshots" in time of what the graph looks like from a particular context. While the twin manager 1008 may contain the history and the current state of the graph based upon schema evaluation, a consumer can retain a copy of that data, and thereby create dynamic views using the change feed.

The schema and ontology 1054 can define the message schema and graph ontology of the twin manager 1008. The message schema can define what format messages received by the messaging manager 1040 should have, e.g., what parameters, what formats, etc. The ontology can define graph projections, e.g., the ontology that a user wishes to view. For example, various systems, applications, and/or users can be associated with a graph ontology. Accordingly, when the graph projection manager 1056 generates a graph projection for a user, system, or subscription, the graph projection manager 1056 can generate a graph projection according to the ontology specific to the user. For example, the ontology can define what types of entities are related in what order in a graph, for example, for the ontology for a subscription of "Customer A," the graph projection manager 1056 can create relationships for a graph projection based on the rule:

Region←→Building←→Floor←→Space←→Asset

For the ontology of a subscription of "Customer B," the graph projection manager 1056 can create relationships based on the rule:

Building←→Floor←→Asset

The policy manager 1058 can be configured to respond to requests from other applications and/or systems for policies. The policy manager 1058 can consult a graph projection to determine what permissions different applications, users, and/or devices have. The graph projection can indicate various permissions that different types of entities have and the policy manager 1058 can search the graph projection to identify the permissions of a particular entity. The policy manager 1058 can facilitate fine grain access control with user permissions. The policy manager 1058 can apply permissions across a graph, e.g., if "user can view all data associated with floor 1" then they see all subsystem data for that floor, e.g., surveillance cameras, HVAC devices, fire detection and response devices, etc.

The twin manager 1008 includes a query manager 1065 and a twin function manager 1067. The query manger 1065 can be configured to handle queries received from a requesting system, e.g., the user device 1076, the applications 1010, and/or any other system. The query manager 1065 can receive queries that include query parameters and context. The query manager 1065 can query the graph projection database 1062 with the query parameters to retrieve a result. The query manager 1065 can then cause an event processor, e.g., a twin function, to operate based on the result and the context. In some embodiments, the query manager 1065 can select the twin function based on the context and/or perform operations based on the context. In some embodiments, the query manager 1065 is configured to perform a variety of differing operations. For example, in some instances, the query manager 1065 is configured to perform any of the operations performed by the query manager described in U.S. patent application Ser. No. 17/537,046, filed Nov. 29, 2021, the entirety of which is incorporated by reference herein.

The twin function manager 1067 can be configured to manage the execution of twin functions. The twin function manager 1067 can receive an indication of a context query that identifies a particular data element and/or pattern in the graph projection database 1062. Responsive to the particular data element and/or pattern occurring in the graph projection database 1062 (e.g., based on a new data event added to the graph projection database 1062 and/or change to nodes or edges of the graph projection database 1062), the twin function manager 1067 can cause a particular twin function to execute. The twin function can be executed based on an event, context, and/or rules. The event can be data that the twin function executes against. The context can be information that provides a contextual description of the data, e.g., what device the event is associated with, what control point should be updated based on the event, etc. The twin function manager 1067 can be configured to perform a variety of differing operations. For example, in some instances, the twin function manager 1067 is configured to perform any of the operations of the twin function manager described in U.S. patent application Ser. No. 17/537,046, referenced above.

EXAMPLES

According to one example, a control method for refrigerant leakage diagnosis of an air-conditioning system is provided. The air-conditioning system comprises a unit that utilizes a control method for refrigerant leakage diagnosis of the air-conditioning system that comprises the following steps: (Step 1) in a case of a combination test, obtaining test data sequences, obtaining reconstruction error enhancement coefficients of k sensors according to the test data sequences, obtaining test thresholds based on the reconstruction error enhancement coefficients, and obtaining test threshold proportional coefficients according to the test thresholds; (Step 2) in a case of no refrigerant leakage, obtaining test data sequences, and obtaining several diagnostic thresholds based on the reconstruction error enhancement coefficients and the test threshold proportional coefficients; and (Step 3) in a refrigerant leakage diagnosis process, obtaining test data sequences, obtaining enhanced reconstruction errors based on the k reconstruction error enhancement coefficients, comparing the enhanced reconstruction errors with the several diagnostic thresholds, and performing refrigerant leakage diagnosis.

In some examples, the air-conditioning system comprises the unit and the sensors j (j=1, 2, . . . , k), the k sensors obtain state parameters from the unit, and the control method for refrigerant leakage diagnosis of the air-conditioning system includes, in Step 1, in the case of the combination test under different refrigerant charging amounts: (i) obtaining all test data sequences Cj (j=1, 2, . . . , k) for each sensor j in the k sensors, each test data sequence Cj comprising sequence elements $$c_i^j,$$

wherein i=1, 2, . . . , m, and the m represents a number of data points obtained from the combination test according to a sampling period; (ii) according to the test data sequences Cj, obtaining the reconstruction error enhancement coefficients $\beta_1, \beta_2, \ldots, \beta_k$ of the k sensors by multiple linear regression; (iii) for each sensor j in the k sensors, obtaining an n-dimensional input subvector $$x_{i+1}^j$$

from the test data sequences Cj, wherein i=1, 2, . . . , n, and the n represents interception period time; (iv) for the n-dimensional input subvector obtaining subsequent $$x_i^j,$$

obtaining subsequent n-dimensional input subvectors $$x_{i+1}^j$$

from the test data sequences Cj, wherein i=1, 2, . . . , n; (v) obtaining an n-dimensional output subvector $$\hat{x}_{i+1}^j$$

corresponding to the n-dimensional input subvector $$x_i^j,$$

wherein i=1, 2, . . . , n; (vi) obtaining respective reconstruction errors of the k n-dimensional output subvectors $$\hat{x}_{i+1}^j$$

and the k n-dimensional input subvectors $$x_{i+1}^j;$$

and (vii) based on the k reconstruction errors and the reconstruction error enhancement coefficients $\beta_1, \beta_2, \ldots, \beta_k$, obtaining test thresholds g0, g1, g2 and g3 with refrigerant leakage amounts from less to more, and according to the test thresholds g0, g1, g2 and g3, obtaining the test threshold proportional coefficients $\alpha_1$, $\alpha_2$ and $\alpha_3$, wherein $\alpha_1$=g1/g0, $\alpha_2$=g2/g0, and $\alpha_3$=g3/g0.

In some examples, the control method for refrigerant leakage diagnosis of the air-conditioning system includes, in Step 2, in the case of no refrigerant leakage: (i) obtaining all test data sequences Cj (j=1, 2, . . . , k) for each sensor j in the k sensors, each test data sequence Cj comprising sequence elements $$c_i^j,$$

wherein i=1, 2, . . . , m, and the m represents a number of data points obtained from the combination test according to a time period; (ii) for each sensor j in the k sensors, obtaining an n-dimensional input subvector $$x_i^j$$

from the test data sequences Cj, wherein i=1, 2, . . . , n, and the n represents interception period time; (iii) for the n-dimensional input subvector $$x_i^j,$$

obtaining subsequent n-dimensional input subvectors $$x_{i+1}^{j}$$

from the test data sequences Cj, wherein i=1, 2, . . . , n; (iv) obtaining an n-dimensional output subvector $$\hat{x}_{i+1}^{j}$$

corresponding to the n-dimensional input subvector $$x_{i}^{j},$$

wherein i=1, 2, . . . , n; (v) obtaining respective reconstruction errors of the k n-dimensional output subvectors $$\hat{x}_{i+1}^{j}$$

and the k n-dimensional input subvectors $$x_{i+1}^{j};$$

and (vi) based on the k reconstruction errors, the reconstruction error enhancement coefficients $\beta_1, \beta_2, \ldots, \beta_k$ and the test threshold proportional coefficients $\alpha_1$, $\alpha_2$ and $\alpha_3$, obtaining several diagnostic thresholds G0, G1, G2 and G3, wherein $G1=G0\times\alpha_1$, $G2=G0\times\alpha_2$, and $G3=G0\times\alpha_3$.

In some examples, the control method for refrigerant leakage diagnosis of the air-conditioning system includes, in Step 3, in the refrigerant leakage diagnosis process: (i) for each sensor j in the k sensors, obtaining all test data sequences Cj (j=1, 2, . . . , k), each test data sequence Cj comprising sequence elements $$c_{i}^{j},$$

wherein i=1, 2, . . . , m, and the m represents a number of data points obtained from the combination test according to a time period; (ii) for each sensor j in the k sensors, obtaining an n-dimensional input subvector $$x_{i}^{j}$$

from the test data sequences Cj, wherein i=1, 2, . . . , n, and the n represents period time; (iii) for the n-dimensional input subvector $$x_{i+1}^{j},$$

obtaining subsequent n-dimensional input subvectors $$x_{i}^{j}$$

from the test data sequences Cj, wherein i=1, 2, . . . , n; (iv) obtaining an n-dimensional output subvector $$\hat{x}_{i+1}^{j}$$

corresponding to the n-dimensional input subvector $$x_{i}^{j},$$

wherein i=1, 2, . . . , n; (v) obtaining reconstruction errors of the n-dimensional output subvectors $$\hat{x}_{i+1}^{j}$$

and the n-dimensional input subvectors $$x_{i+1}^{j};$$

(vi) obtaining enhanced reconstruction errors based on the reconstruction errors of the k sensors and the k reconstruction error enhancement coefficients $\beta_1, \beta_2, \ldots, \beta_k$ obtained through calculation; (vii) comparing the enhanced reconstruction errors with the several diagnostic thresholds G0, G1, G2 and G3 to perform refrigerant leakage diagnosis.

In some examples, Step 1 is performed under several different refrigerant charging amounts, and the several different refrigerant charging amounts comprise no leakage, a first leakage amount, a second leakage amount, and a third leakage amount. In some examples, when Step 1 (vi), Step 2 (v), and Step 3 (v) are executed to obtain the reconstruction errors, calculation is performed using the following formula:

$$RE_j = \frac{1}{n}\sum_{i=1}^{n}\left|x_{i+1}^{j} - \hat{x}_{i+1}^{j}\right|.$$

In some examples, when the Step 1 (vii) is executed to obtain the test thresholds g0, g1, g2, and g3, the following steps are executed: calculating the enhanced reconstruction error of each output subvector through the following formula:

$$EnhancedRE_i = \Sigma_{j=1}^{k}\beta_j RE_j;$$

screening out no-leakage test data from a test data set, and sorting the obtained multiple enhanced reconstruction errors from high to low; and using an average value of first o enhanced reconstruction errors after sorting as an original test threshold g0, a specific calculation formula being as follows:

$$g0 = \frac{1}{o}\sum_{i=1}^{o} EnhancedRE_i,$$

wherein i represents a serial number of the first o enhanced reconstruction errors after sorting; screening out test data under the first leakage amount, the second leakage amount and the third leakage amount from the test data set; and using average values of the first o enhanced reconstruction errors after sorting under the first leakage amount, the second leakage amount and the third leakage amount as a first test threshold g1, a second test threshold g2 and a third test threshold g3.

In some examples, when the step S01(*ii*) is executed to obtain $\beta_1, \beta_2, \ldots, \beta_k$, the following steps are executed: using the refrigerant charging amounts as dependent variables and using other screening data as independent variables, thereby establishing a function form as follows:

$$\hat{y}_i = \beta_0 + \beta_1 x_i^1 + \beta_2 x_i^2 + \ldots + \beta_k x_i^k,$$

wherein i represents a sample, wherein i=1, 2, . . . , m, the m represents that m time samples exist, and $\hat{y}_i$ represents the refrigerant charging amounts obtained by regression; an estimation method of multiple linear regression parameters usually adopts a least square method, for the sample i, a difference between a measured value and an estimated value is:

$$y_i - \hat{y}_i = y_i - (\beta_0 + \beta_1 x_i^1 + \beta_2 x_i^2 + \ldots + \beta_k x_i^k),$$

for all m time samples, the formula for the sum of squares of the difference between the measured value and the estimated value is as follows:

$$Q = \Sigma_{i=1}^{n}\left[y_i - (\beta_0 + \beta_1 x_i^1 + \beta_2 x_i^2 + \ldots + \beta_k x_i^k)\right]^2,$$

a principle of the least squares method is to find a set of coefficients $\beta_0, \beta_1, \ldots, \beta_k$ to minimize Q.

In some examples, when the step S02(*vi*) is executed to obtain the several diagnostic thresholds G0, G1, G2 and G3, the following steps are executed: selecting the largest enhanced reconstruction error from the enhanced restoration deviations of multiple output vector groups as the no-leakage diagnostic threshold G0, a specific calculation formula being as follows: G0=max(EnhancedRE$_i$), wherein i=2, 3, 4, . . . .

In some examples, when the step S03(*vi*) is executed to obtain the enhanced reconstruction errors, a calculation is performed using the following formula:

$$EnhancedRE_i = \Sigma_{j=1}^{k} \beta_j RE_{i+1}^{j},$$

wherein i=1, 2, 3, . . . .

In some examples, the control method further includes: finding sensitive features from a large number of system sensor parameters; and separating refrigerant leakage from other failure factors.

In some examples, an air-conditioning system is provided that comprises a unit, sensors j (j=1, 2, . . . , k) and a controller, the sensors obtaining vector parameters from the unit, and the controller controlling the air-conditioning system according to parameters obtained by the methods described above.

Configuration of Exemplary Embodiments

The construction and arrangement of the systems and methods as shown in the various exemplary embodiments are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.). For example, the position of elements can be reversed or otherwise varied, and the nature or number of discrete elements or positions can be altered or varied. Accordingly, all such modifications are intended to be included within the scope of the present disclosure. The order or sequence of any process or method steps can be varied or re-sequenced according to alternative embodiments. Other substitutions, modifications, changes, and omissions can be made in the design, operating conditions and arrangement of the exemplary embodiments without departing from the scope of the present disclosure.

The present disclosure contemplates methods, systems and program products on any machine-readable media for accomplishing various operations. The embodiments of the present disclosure can be implemented using existing computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. Combinations of the above are also included within the scope of machine-readable media. Machine-executable instructions include, for example, instructions and data which cause a general-purpose computer, special purpose computer, or special purpose processing machines to perform a certain function or group of functions.

Although the figures show a specific order of method steps, the order of the steps may differ from what is depicted. Also, two or more steps can be performed concurrently or with partial concurrence. Such variation will depend on the software and hardware systems chosen and on designer choice. All such variations are within the scope of the disclosure. Likewise, software implementations could be accomplished with standard programming techniques with rule-based logic and other logic to accomplish the various connection steps, processing steps, comparison steps and decision steps.

What is claimed is:

1. A system for refrigerant leakage detection, the system comprising:

one or more sensors configured to detect one or more parameters of a building system including a refrigerant;

one or more storage devices storing instructions thereon that, when executed by one or more processors, cause the one or more processors to:

receive sensor data from the one or more sensors;

apply the sensor data to a long short-term memory (LSTM) model to generate predicted sensor data corresponding to the one or more sensors;

receive subsequent sensor data from the one or more sensors;

compare the predicted sensor data to the subsequent sensor data, wherein comparing the predicted sensor data to the subsequent sensor data includes determining reconstruction errors for each of the one or more sensors;

determine that the building system has a refrigerant leakage based on at least one reconstruction error exceeding a threshold value, wherein the threshold value is one of a plurality of threshold values corresponding to different refrigerant leakage severities and determining that the building system has the refrigerant leakage includes determining a severity of the refrigerant leakage based on the refrigerant leakage severity corresponding to the exceeded threshold value; and responsive to determining that the building system has the refrigerant leakage, take an action to address the refrigerant leakage.

2. The system of claim 1, wherein the instructions further cause the one or more processors to:

receive a plurality of no-leakage test data samples and a plurality of leakage test data samples from the one or more sensors, the plurality of no-leakage test data samples being collected under a no-leakage condition where the building system has no refrigerant leakage, the plurality of leakage test data samples being collected under at least one leakage condition where the building system has at least one leakage severity, the plurality of no-leakage test data samples and the plurality of leakage test data samples being collected on a rolling and overlapping basis such that consecutive no-leakage test data samples include overlapping no-leakage data elements and consecutive leakage test data samples include overlapping leakage data elements;

apply the plurality of no-leakage test data samples and the plurality of leakage test data samples to the LSTM model;

determine a test reconstruction error for each of the plurality of no-leakage test data samples and each of the plurality of leakage test data samples; and determine threshold coefficients for the no-leakage condition and the at least one leakage condition based on the test reconstruction errors.

3. The system of claim 2, wherein the plurality of threshold values are determined based on a maximum no-leakage threshold value and proportional coefficients generated using the determined threshold coefficients.

4. The system of claim 2, wherein the threshold coefficient is determined for the no-leakage condition by averaging the test reconstruction errors of a predetermined number of no-leakage test data samples having the highest values and the threshold coefficient is determined for the at least one leakage condition by averaging the test reconstruction errors of a predetermined number of leakage test data samples having the highest values.

5. The system of claim 1, wherein the building system comprises one of a heating, cooling, and/or air conditioning (HVAC) system, a chiller, or an air-conditioning unit.

6. The system of claim 1, wherein the action comprises one or more of activating, deactivating, or modifying operation of a device to reduce or stop the refrigerant leakage, raising an alarm indicating the refrigerant leakage, or generating a report indicating the refrigerant leakage.

7. A system for refrigerant leakage detection, the system comprising:

one or more sensors configured to detect one or more parameters of a building system including a refrigerant;

one or more storage devices storing instructions thereon that, when executed by one or more processors, cause the one or more processors to:

determine reconstruction error enhancement coefficients for each of the one or more sensors;

receive sensor data from the one or more sensors;

apply the sensor data to a long short-term memory (LSTM) model to generate predicted sensor data corresponding to the one or more sensors;

receive subsequent sensor data from the one or more sensors;

compare the predicted sensor data to the subsequent sensor data to generate one or more reconstruction errors;

apply the reconstruction error enhancement coefficients to the one or more reconstruction errors to generate one or more enhanced reconstruction errors;

determine that the building system has a refrigerant leakage based on the one or more enhanced reconstruction errors; and responsive to determining that the building system has the refrigerant leakage, take an action to address the refrigerant leakage.

8. The system of claim 7, wherein the reconstruction error enhancement coefficients are indicative of a given reconstruction error of a given sensor being related to refrigerant leakage.

9. The system of claim 7, wherein the instructions further cause the one or more processors to:

receive a plurality of no-leakage test data samples and a plurality of leakage test data samples from the one or more sensors, the plurality of no-leakage test data samples being collected under a no-leakage condition where the building system has no refrigerant leakage, the plurality of leakage test data samples being collected under at least one leakage condition where the building system has at least one leakage severity, the plurality of no-leakage test data samples and the plurality of leakage test data samples being collected on a rolling and overlapping basis such that consecutive no-leakage test data samples include overlapping no-leakage data elements and consecutive leakage test data samples include overlapping leakage data elements;

apply the plurality of no-leakage test data samples and the plurality of leakage test data samples to the LSTM model; and determine a test reconstruction error for each of the plurality of no-leakage test data samples and each of the plurality of leakage test data samples.

10. The system of claim 9, wherein the reconstruction error enhancement coefficients are determined by performing a multiple linear regression on the plurality of no-leakage test data samples and the plurality of leakage test data samples where a refrigerant charge amount is used as a dependent variable and test sensor data from the plurality of no-leakage test data samples and the plurality of leakage test data samples are used as independent variables.

11. The system of claim 9, wherein the instructions further cause the one or more processors to:

apply the reconstruction error enhancement coefficients to the test reconstruction errors to generate enhanced test reconstruction errors; and determine threshold coefficients for the no-leakage condition and the at least one leakage condition based on the enhanced test reconstruction errors.

12. The system of claim 11, wherein the threshold coefficient is determined for the no-leakage condition by averaging the enhanced test reconstruction errors of a predetermined number of no-leakage test data samples having the highest values and the threshold coefficient is determined for the at least one leakage condition by averaging the enhanced test reconstruction errors of a predetermined number of leakage test data samples having the highest values.

13. A method for refrigerant leakage detection, the method comprising:

receiving, by one or more processors of a system, sensor data from one or more sensors associated with a building system including a refrigerant;

applying, by the one or more processors, the sensor data to a machine learning model to generate predicted sensor data corresponding to the one or more sensors, wherein the machine learning model is a long short-term memory (LSTM) model;

receiving, by the one or more processors, subsequent sensor data from the one or more sensors;

comparing, by the one or more processors, the predicted sensor data to the subsequent sensor data, wherein comparing the predicted sensor data to the subsequent sensor data includes generating one or more reconstruction errors;

determining, by the one or more processors, reconstruction error enhancement coefficients for each of the one or more sensors;

applying, by the one or more processors, the reconstruction error enhancement coefficients to the one or more reconstruction errors to generate one or more enhanced reconstruction errors;

determining, by the one or more processors, that the building system has a refrigerant leakage using the one or more enhanced reconstruction errors; and responsive to determining that the building system has the refrigerant leakage, taking, by the one or more processors, an action to address the refrigerant leakage.

14. The method of claim 13, wherein the reconstruction error enhancement coefficients are indicative of a given reconstruction error of a given sensor being related to refrigerant leakage.

15. The method of claim 13, further comprising:

receiving, by the one or more processors, a plurality of no-leakage test data samples and a plurality of leakage test data samples from the one or more sensors, the plurality of no-leakage test data samples being collected under a no-leakage condition where the building system has no refrigerant leakage, the plurality of leakage test data samples being collected under at least one leakage condition where the building system has at least one leakage severity, the plurality of no-leakage test data samples and the plurality of leakage test data samples being collected on a rolling and overlapping basis such that consecutive no-leakage test data samples include overlapping no-leakage data elements and consecutive leakage test data samples include overlapping leakage data elements;

applying, by the one or more processors, the plurality of no-leakage test data samples and the plurality of leakage test data samples to the LSTM model; and determining, by the one or more processors, a test reconstruction error for each of the plurality of no-leakage test data samples and each of the plurality of leakage test data samples, and wherein the reconstruction error enhancement coefficients are determined by performing a multiple linear regression on the plurality of no-leakage test data samples and the plurality of leakage test data samples where a refrigerant charge amount is used as a dependent variable and test sensor data from the plurality of no-leakage test data samples and the plurality of leakage test data samples are used as independent variables.

* * * * *